US006112046A

United States Patent [19]

Suzuki et al.

[11] Patent Number: 6,112,046

[45] Date of Patent: Aug. 29, 2000

[54] IMAGE FORMING APPARATUS HAVING RECYCLING OF RESIDUAL TONER

[75] Inventors: Koji Suzuki, Kanagawa; Hiroshi Saitoh, Chiba; Hiroshi Ishii; Ichirou Komuro, both of Kanagawa; Toshihiro Sugiyama, Tokyo; Takashi Hodoshima, Kanagawa; Nobuo Kasahara, Kanagawa; Satoshi Muramatsu, Kanagawa, all of Japan

[73] Assignee: Ricoh Company, Ltd., Tokyo, Japan

[21] Appl. No.: 09/100,313

[22] Filed: Jun. 19, 1998

[30] Foreign Application Priority Data

| | | | |
|---|---|---|---|
| Jun. 20, 1997 | [JP] | Japan | 9-180491 |
| Jun. 25, 1997 | [JP] | Japan | 9-184435 |
| Jul. 4, 1997 | [JP] | Japan | 9-180131 |
| Oct. 8, 1997 | [JP] | Japan | 9-291604 |
| Feb. 13, 1998 | [JP] | Japan | 10-031758 |

[51] Int. Cl.[7] ..... G03G 21/10

[52] U.S. Cl. ..... 399/359

[58] Field of Search ..... 399/358, 359, 399/360, 120, 58, 35

[56] References Cited

U.S. PATENT DOCUMENTS

| | | | |
|---|---|---|---|
| 4,260,073 | 4/1981 | Baumann | 222/1 |
| 4,724,459 | 2/1988 | Ford | 399/344 |
| 5,268,720 | 12/1993 | Saitoh et al. | 399/110 |
| 5,400,127 | 3/1995 | Arai et al. | 399/71 |
| 5,493,382 | 2/1996 | Takagaki et al. | 399/359 |
| 5,521,690 | 5/1996 | Taffler et al. | 399/93 |
| 5,526,100 | 6/1996 | Misago et al. | 399/29 |
| 5,592,267 | 1/1997 | Misago et al. | 399/62 |
| 5,734,957 | 3/1998 | Ogawa et al. | 399/359 |

FOREIGN PATENT DOCUMENTS

| | | |
|---|---|---|
| 56-070577 | 6/1981 | Japan . |
| 59-148080 | 8/1984 | Japan . |
| 07-219329 | 8/1995 | Japan . |
| 10-069200 | 3/1998 | Japan . |

*Primary Examiner*—Robert Beatty
*Attorney, Agent, or Firm*—Oblon, Spivak, McClelland, Maier & Neustadt, P.C.

[57] ABSTRACT

An image forming apparatus capable of collecting toner left on an image carrier after image transfer during an electrophotographic process, and returning the toner to a developing unit for reuse in the form of an air-toner mixture is disclosed. A toner conveying device includes a screw pump and a hopper portion positioned upstream of the screw pump in the intended direction of toner conveyance. When the collected toner accumulating in the hopper portion reaches a preselected amount, the toner conveying device is caused to start and stop operating at a specific timing.

67 Claims, 19 Drawing Sheets

IMAGE FORMING APPARATUS HAVING RECYCLING OF RESIDUAL TONER

BACKGROUND OF THE INVENTION

1. Field of the Invention

The present invention relates to a printer, facsimile apparatus, copier, multiplex machine or similar electrophotographic image forming apparatus. More particularly, the present invention is concerned with an image forming apparatus capable of collecting toner left on an image carrier after image transfer and returning it to a developing unit in the form of an air-toner mixture for reuse.

2. Discussion of the Background

It is a common practice with an electrophotographic image forming apparatus to form a latent image electrostatically on an image carrier, develop the latent image to produce a corresponding toner image, transfer the toner image to a paper or similar recording medium, and fix the toner image on the paper. There has been proposed an image forming apparatus including a toner recycling mechanism for collecting, after the transfer of the toner image from the image carrier to the paper, toner left on the image carrier with a cleaning unit, and conveying the collected toner to a developing unit or a collected toner storing section provided independently of the cleaning unit. The conventional toner recycling mechanism is implemented by any one of the following systems:

(1) a system communicating the toner outlet of the cleaning unit to the developing unit or the collected toner storing section by a piping in which a coil screw is accommodated, and causing the coil screw to convey the collected toner to the developing unit or the storing section, as taught in, e.g., Japanese Patent Laid-Open Publication No. 6-175488;

(2) a system in which the collected toner storing section is positioned below the toner outlet of the cleaning unit, so that the collected toner can be transferred to the storing section mainly due to its own weight; and (3) a system using a powder screw pump, generally referred to as a Mono pump, having a rotor for driving the toner of a developer in its axial direction and a stator formed with a passage surrounding the rotor and contacting the rotor in the passage, and air feeding means for fluidizing the developer to be conveyed by the screw pump; the toner is conveyed via a flexible piping in the form of an air-toner mixture, as disclosed in, e.g., Japanese Patent Laid-Open Publication No. 7-219329.

The above system (1) has some problems left unsolved, as follows. The coil screw must be extended as far as the vicinity of the developing unit or the collected toner storing section. Because the conveyance path must be free from bends in order to guarantee the rotation of the coil screw, it is necessary to arrange only a linear path or a gently curved path. The toner storing section should preferably be positioned below the toner outlet of the cleaning unit. A frictional load acting between the coil screw and the piping while the screw is in rotation is heavy and increases a torque for rotating the screw, rendering long-distance conveyance difficult to achieve. In addition, the above load causes a stress to act in the toner being conveyed and thereby causes the toner to cohere or to melt due to heat. The system (1) is not practicable without resorting to bulky and sophisticated structural elements and is therefore undesirable from the standpoint of durability and easy maintenance. Moreover, because the conveying device is limited in position, the image forming apparatus is bulky, complicated and expensive.

The system (2) allows the toner conveying device to convey the collected toner relatively easily. However, because the collected toner storing section or the developing unit must be arranged substantially integrally with the cleaning unit, the system (2) is applicable only to low speed machines, i.e., user-oriented printers and copiers, due to limitations on position and the amount of toner which can be stored.

The system (3) capable of conveying stored toner or collected toner with the screw pump via, e.g., a flexible piping frees the toner storing section and toner collecting section from positional limitations, and therefore allows the toner to be surely conveyed with a simple construction. Because the air feeding means fluidizes the toner, the toner can be stably conveyed by the conveying device in the form of an air-toner mixture. The toner is therefore free from a stress and prevented from cohering or melting due to heat. However, the problem with the screw pump is that because the rotor formed of metal slides on the stator formed of rubber, the inside diameter of the stator increases little by little due to wear and creep. As a result, the amount of bite between the stator and rotor decreases and brings about the reverse flow of air to the inlet side of the screw pump via the gap between the stator and the rotor after the delivery from the pump. Such a reverse flow obstructs the conveyance of the toner. The screw pump is therefore determined to have reached the end of its life when the reverse flow occurs. It follows that the life of the screw pump is shorter than the lifes of the other parts, making the system (3) difficult to practice. While a greater amount of bite between the rotor and the stator may be set beforehand, such a scheme would bring about the blocking and deterioration of the collected toner due to temperature elevation ascribable to friction to act between the rotor and the stator during continuous operation. The blocking and deterioration of the toner would lower image quality and toner conveyance quality. Moreover, while the screw pump is continuously operated, air fed under pressure from the air pump continuously enters the developing unit and causes the toner to fly about by increasing the internal pressure of the developing unit.

Technologies relating to the present invention are also disclosed in, e.g., Japanese Patent Laid-Open Publication Nos. 58-163978, 61-67074, 5-27649, 6-342240, 7-77906, and 7-104631.

SUMMARY OF THE INVENTION

It is therefore an object of the present invention to provide an image forming apparatus capable of conveying collected toner surely and stably in the form of an air-toner mixture.

It is another object of the present invention to provide an image forming apparatus having a long service life and capable of conveying collected toner surely and stably despite aging.

It is still another object of the present invention to provide a small size, low cost image forming apparatus needing a minimum of replacement of structural elements.

It is a further object of the present invention to provide an image forming apparatus causing a minimum of deterioration of toner to occur and preventing the toner from flying about in a developing unit.

In accordance with the present invention, an image forming apparatus capable of conveying toner collected by cleaning means to a preselected position includes a toner conveying device including air stream conveying means and air feeding means for conveying the toner to the preselected position in the form of an air-toner mixture. A hopper portion is positioned upstream of the toner conveying device in the intended direction of toner conveyance for causing the toner to accumulate in the hopper portion. The toner conveying device is operated when the toner accumulating in the hopper portion reaches a preselected amount. Alternatively, the toner conveying device may be operated when the toner accumulating in the hopper portion is regarded as having reached the preselected amount.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Preferred embodiments of the image forming apparatus in accordance with the present invention will be described hereinafter. It is to be noted that particular references are used in each of the embodiments, i.e., identical references do not always designate identical structural elements.

1st Embodiment

Figure 1:
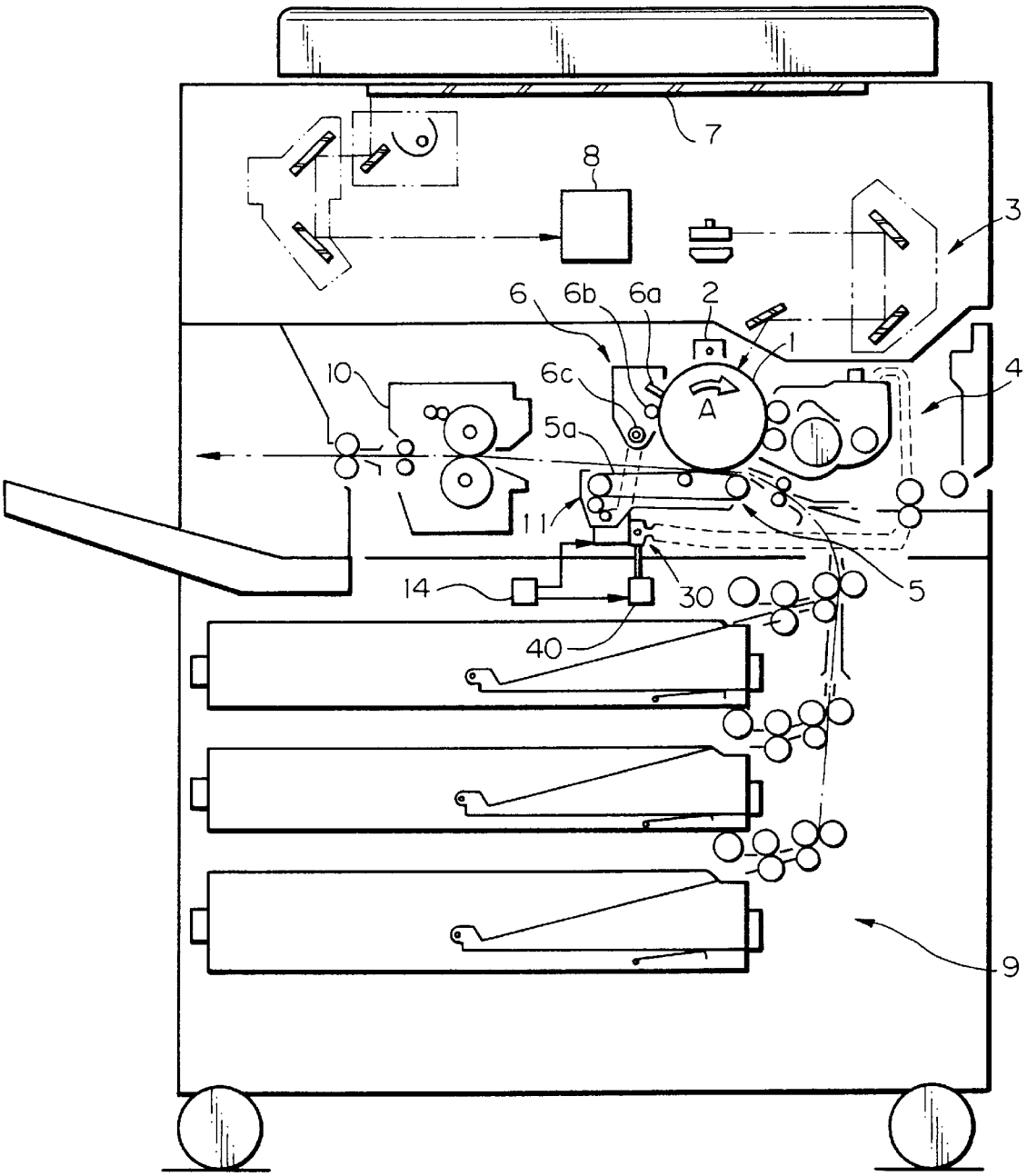
FIG. 1 shows the general construction of a fist embodiment of the image forming apparatus in accordance with the present invention.

Referring to FIG. 1 of the drawings, an image forming apparatus embodying the present invention is shown and implemented as an electrophotographic digital copier by way of example. As shown, the copier includes a photoconductive element in the form of a drum 1. A charger 2, optics 3 for exposure, a developing unit 4, an image transfer device 5 and a drum cleaning unit 6 for executing an electrophotographic process in combination are sequentially arranged around the drum 1 in the direction of rotation of the drum 1 indicated by an arrow in FIG. 1.

A document, not shown, is laid on a glass platen 7 mounted on the top of the copier. The optics 3 reads the document and outputs an image signal representative of the document. A latent image is electrostatically formed on the drum 1 in accordance with the image signal. The latent image is developed by the developing unit 4 to turn out a corresponding toner image. The toner image is electrostatically transferred by the image transfer device 5 to a paper or similar recording medium fed from a paper feed device 9. The paper carrying the toner image thereon is conveyed to a fixing unit 10 and has the toner image fixed thereby. Thereafter, the paper is driven out of the copier.

While most of the toner deposited on the drum 1 by development is transferred to the paper by the image transfer device 5, about 10% of the toner is left on the drum 1. A cleaning blade 6*a* and brush roller 6*b* included in the cleaning unit 6 scrape off the toner left on the drum 1. The toner so scraped off is conveyed to the developing unit 4 by a toner conveying device, which will be described, as recycled toner. The toner also deposits on a transfer belt 5*a* included in the image transfer device 5 and contacting the portions of the non-transferred portions and non-image portions of the drum 1. A belt cleaning unit 11 is associated with the transfer belt 5*a* and includes a cleaning blade 11*a* (see FIG. 4) contacting the belt 5*a*. The cleaning blade 11*a* scrapes off the toner so deposited on the transfer belt 5*a*. This part of the toner is also conveyed to the developing unit 6 by the toner conveying device.

Figure 2:
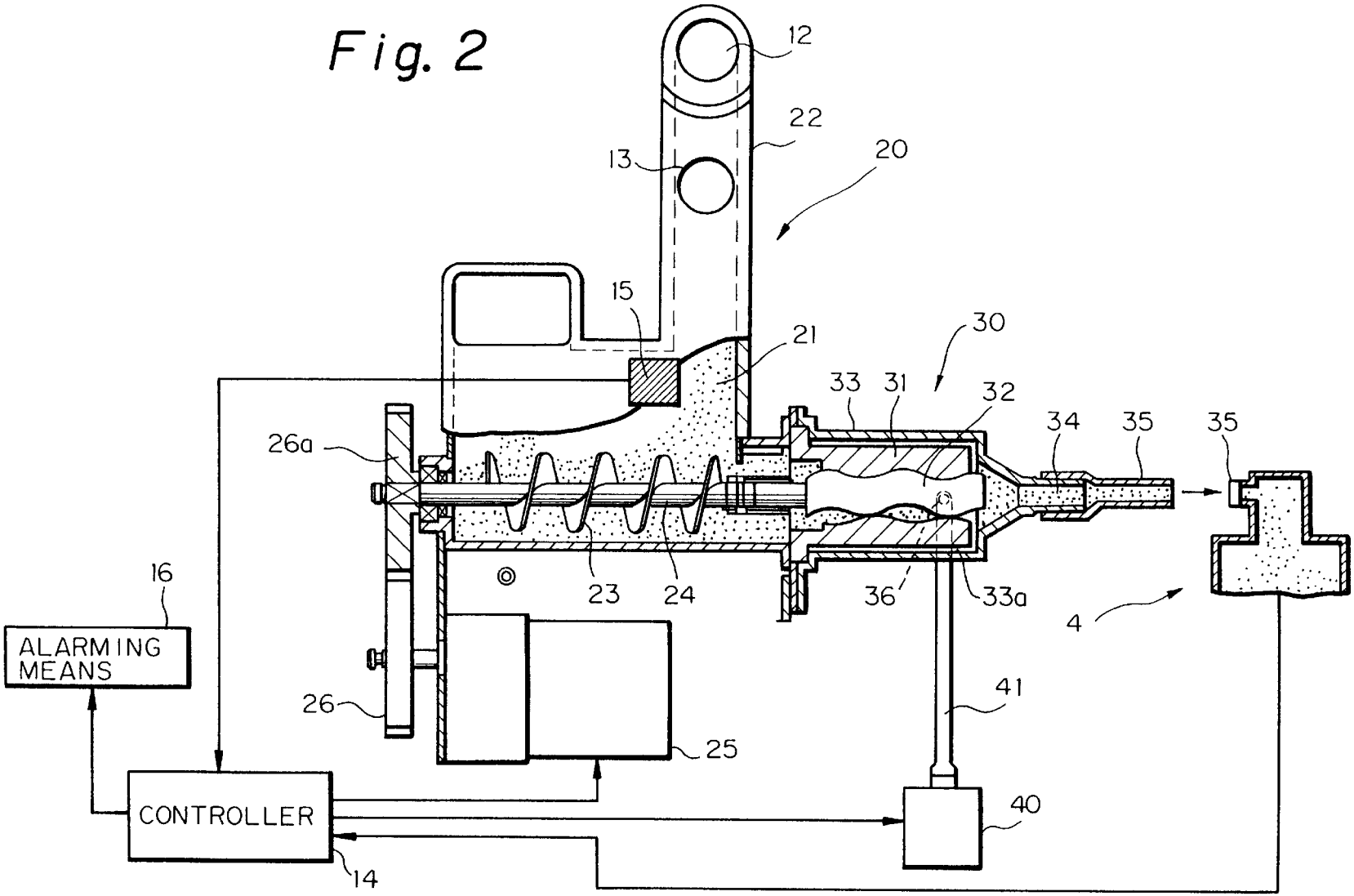
FIG. 2 is a section showing a specific configuration of a toner conveying device included in the first embodiment.

As shown in FIG. 2, the toner conveying device, generally 20, includes a screw pump or toner conveying means 30 and an air pump or air feeding means 40. The toner accumulates in a portion (hopper portion hereinafter) 21 located upstream of the screw pump 30 in the intended direction of toner conveyance. The hopper portion 21 is capable of accommodating a certain amount of toner. Toner inlets 12 and 13 are positioned above the hopper portion 21 and respectively communicated to the drum cleaning unit 6 and belt cleaning unit 11. The inlet 12 positioned above the inlet 11 is communicated to the hopper portion 21 by a toner guide 22. A screw or toner conveying member 23 is positioned in the vicinity of the bottom of the hopper portion 21 and formed on a shaft 24. One end of the shaft 24 protrudes to the outside of the hopper portion 21 and is connected to a drive motor 25 via gears 26 and 26*a*. Alternatively, the screw 23 may be connected to a main motor, not shown, included in the copier via a clutch.

The screw pump, or Nomo pump as generally referred to, 30 has a female screw type stator 31 and a male screw type rotor 32. The stator 31 is formed of rubber or similar elastic material and formed with a double-pitch spiral groove or female screw. The rotor 32 is rotatably received in the stator 31 and coaxially connected to the other end of the screw 23. The rotation of the drive motor 25 is transferred to the screw pump 30 via the screw 23. The stator 31 is supported by a holder 33 outside of the hopper portion 21. That is, the holder 33 surrounds the stator 31 and fixes it in place. A toner outlet 34 is formed in the holder 33. A tubing 35 is implemented as, e.g., a flexible hose and has its one end connected to the toner outlet 34. The other end of the tubing 35 can be easily connected to the developing unit 4. A gap 33*a* of, e.g., about 1 mm is formed between the inner periphery of the holder 33 and the outer periphery of the stator 31 and communicated to the toner outlet 34. An air inlet 36 is formed in the holder 33 and communicated to the gap 33*a*. The air inlet 36 is connected to an air pump 40 by a tubing 41.

A microprocessing unit (MPU) or controller 14 controls the operation of the drive motor 25 and that of the air pump 40. A toner sensor 15 is disposed in the hopper portion 21 in order to determine whether or not the toner in the hopper portion 21 has reached a predetermined amount. The toner sensor 15 sends its output to the MPU 14. In the illustrative embodiment, the toner sensor 15 is implemented as a piezoelectric sensor capable of sensing the toner present on its surface.

Figure 3:
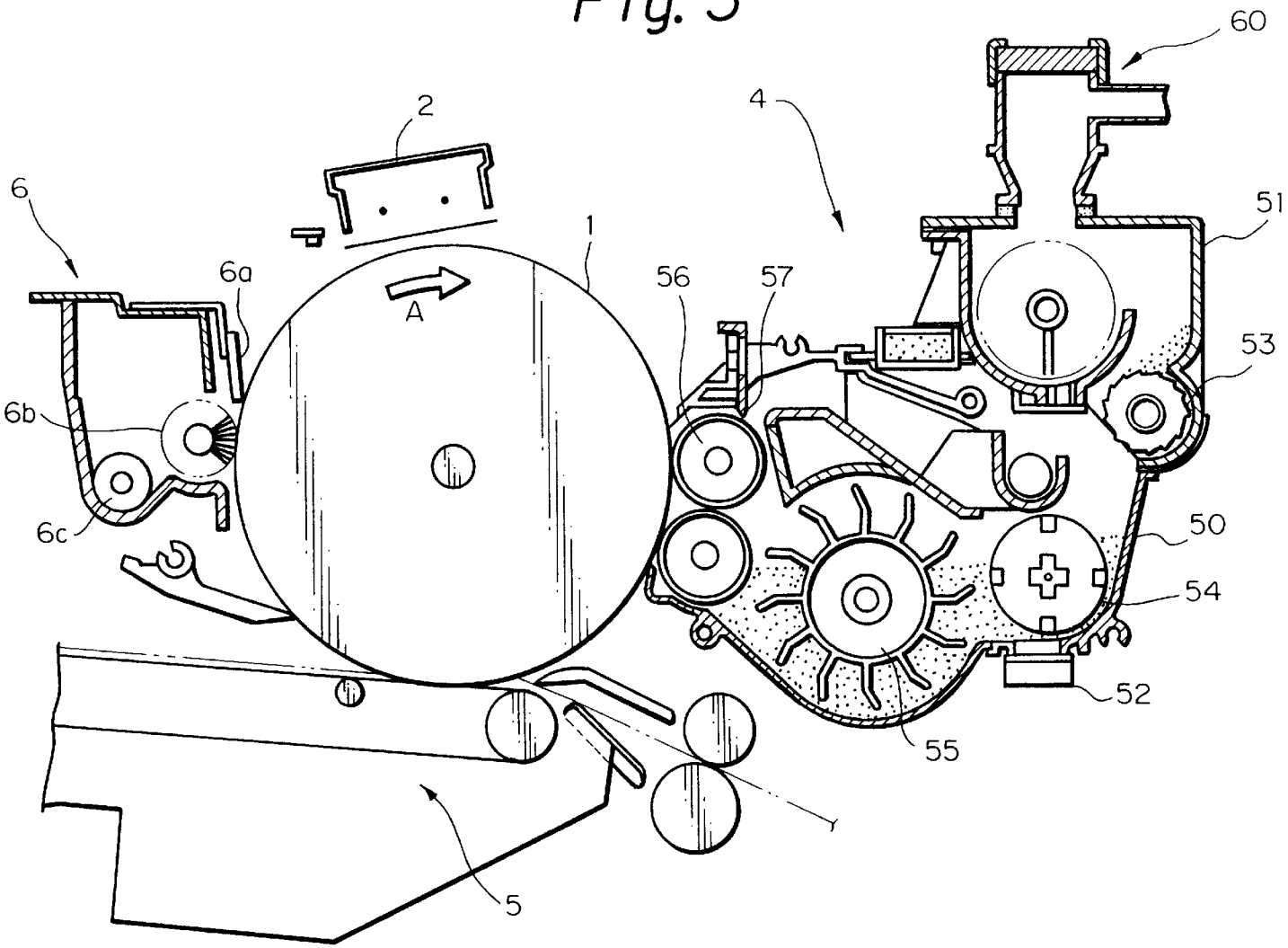
FIG. 3 is a section showing an image forming section also included in the first embodiment.
Figure 4:
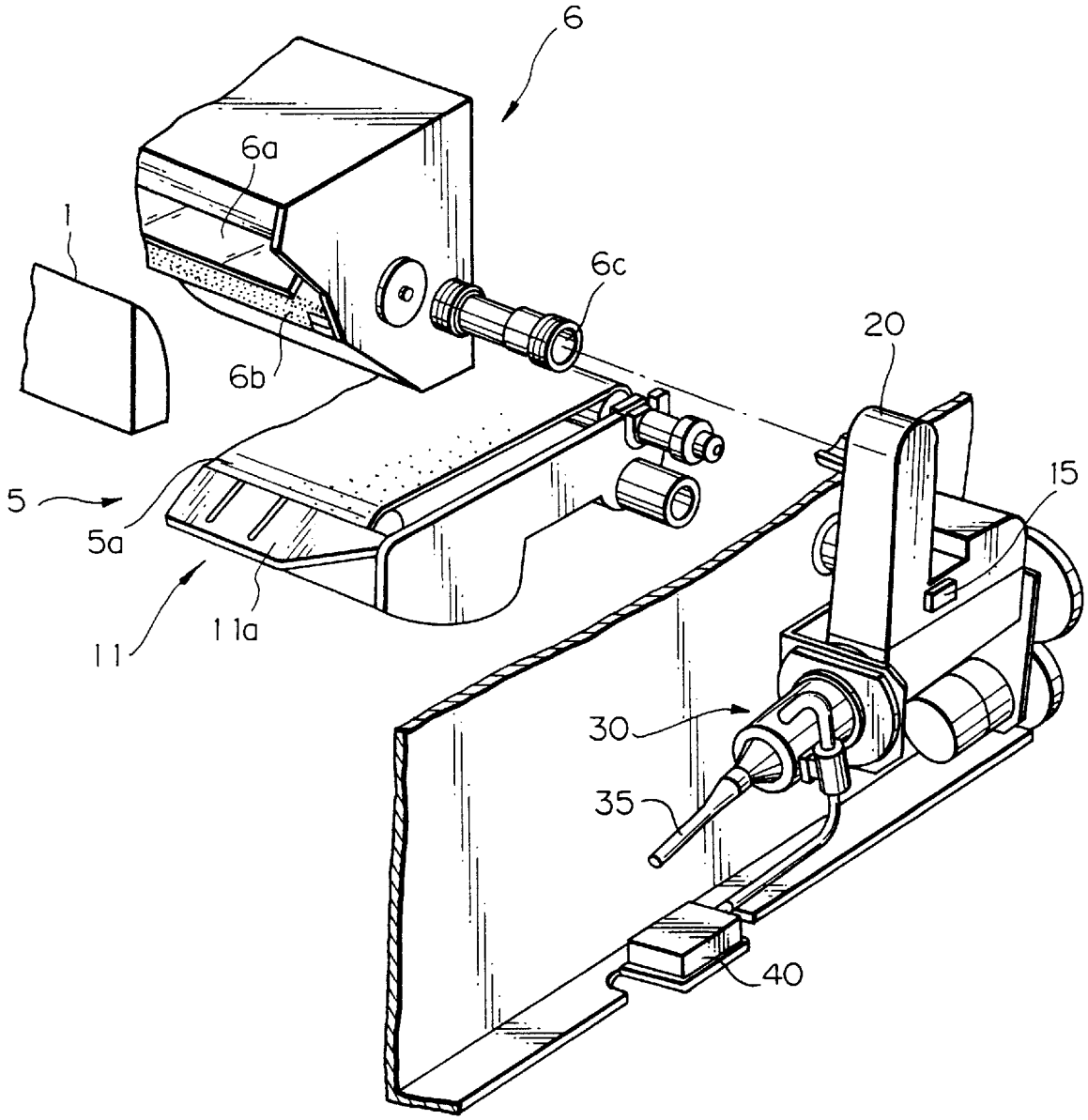
FIG. 4 is an external perspective view of the toner conveying device of FIG. 2.

Reference will be made to FIGS. 3 and 4 for describing the movement of the toner to occur during image formation. In the illustrative embodiment, the developing unit 4 stores a developer in the form of a toner-carrier mixture. When the developing unit 4 develops a latent image with the developer, it consumes the toner contained in the developer and reduces the toner content of the developer. When the toner content of the developer decreases below a preselected value, a toner supply roller 53 is rotated in order to replenish fresh toner from a toner hopper 51. This allows the developer to maintain the expected toner content. The toner content of the developer is measured by a permeability sensor 52 mounted on the casing of the developing unit 4.

The fresh toner replenished from the toner hopper 51 is agitated by an agitator 54 disposed in the developing unit 4, while being charged by friction acting between it and the carrier. The resulting toner-carrier mixture is sent upward to a developing roller 56 by a paddle wheel 55 and deposited on the roller 56 by a magnet disposed in the roller 56. A sleeve forming the outer periphery of the developing roller 56 conveys the developer while a doctor blade 57 scrapes off the excessive part of the developer. When the developer is conveyed to the drum 1, the toner contained in the developer is transferred to a latent image carried on the drum 1 by a bias for development. While the toner is mostly transferred from the drum 1 to a paper by the image transfer device 5, about 10% of the toner is left on the drum 1, as stated earlier.

In FIGS. 3 and 4, the toner left on the drum 1 is removed from the drum 1 by the cleaning blade 6*a* and brush roller 6*b* of the drum cleaning unit 6 and then conveyed to the toner inlet 12, FIG. 2, of the toner conveying device 20 by a coil 6*c*. The toner introduced into the device 20 via the toner inlet 12 drops in the toner guide 22, FIG. 2, due to its own weight, accumulating in the hopper portion 21. Also, the toner left on the transfer belt 5*a* is collected by the belt cleaning unit 11 and brought to the hopper portion 21 via the other toner inlet 13, FIG. 2.

When the toner collected in the hopper portion 21 reaches a preselected amount, the toner sensor 15 sends its output representative of such a condition to the MPU 14. In the illustrative embodiment, the screw pump 30 and air pump 40 of the toner conveying device 20 are usually held inoperative. In response to the above output of the toner sensor 15, the MPU 14 causes the drive motor 25 and air pump 40 to start operating and causes them to stop operating on the elapse of a preselected period of time. Therefore, the screw pump 30 and air pump 40 each is operated intermittently. In this condition, the toner collected by the drum cleaning unit 6 or the belt cleaning unit 11 is conveyed to the developing unit 4 via the tubing 35 in the form of an air-toner mixture. The rotor 32 and stator 31 of the screw pump 30 are, of course, held in an air-tight condition.

As stated above, only when a preselected amount of toner is collected in the hopper portion 21, the screw pump 30 is operated only for a preselected period of time. This minimizes the operation of the screw pump 30 and thereby slows down the wear of the stator 31 and other undesirable occurrences as far as possible. As a result, the life of the screw pump 30 is noticeably extended. Moreover, temperature elevation ascribable to friction acting between the rotor 32 and the stator 31 is reduced, compared to the case wherein the screw pump 30 is continuously operated. This reduces the blocking and deterioration of the collected or recycled toner and insures high image quality even with the recycled toner.

Figure 5:
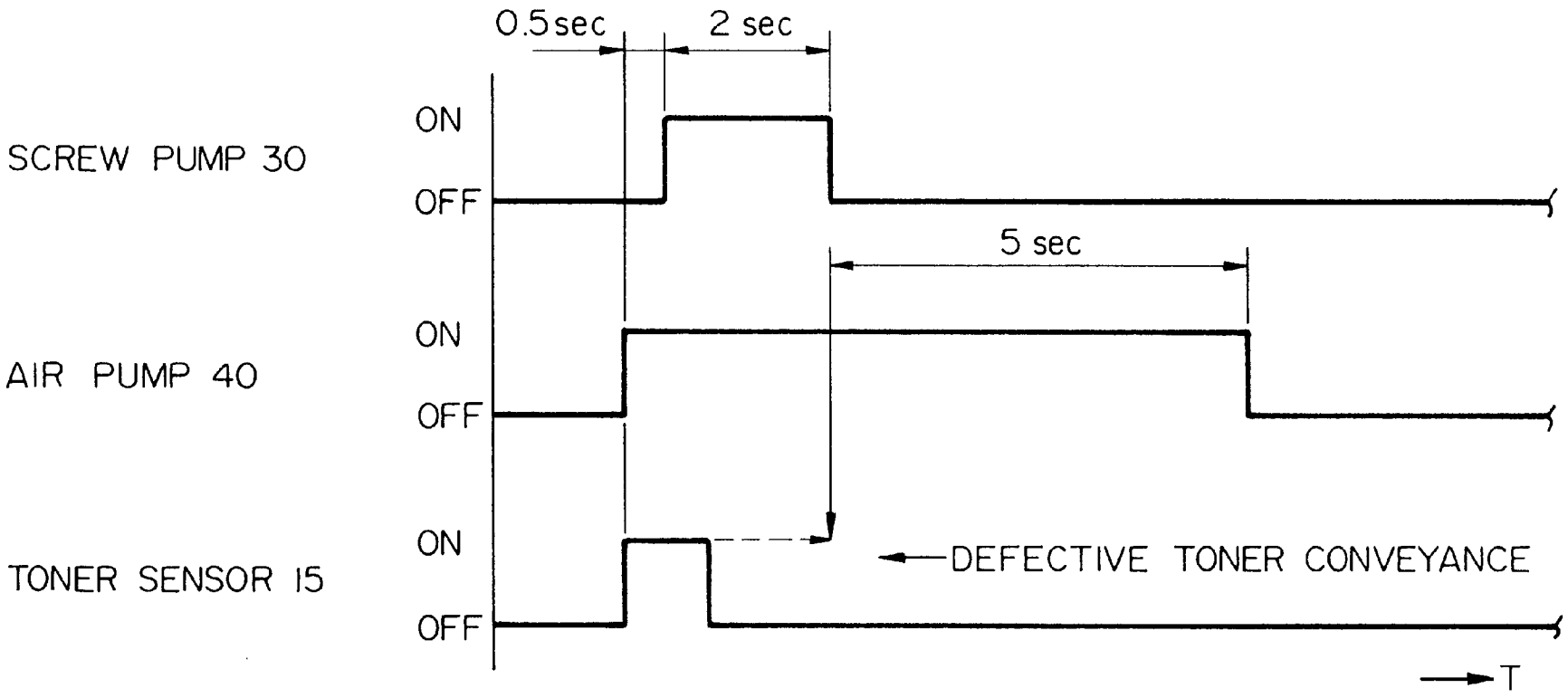
FIG. 5 is a timing chart representative of the operation of the first embodiment.

FIG. 5 shows a relation between the output of the toner sensor 15 and the operation timings of the screw pump 30 and air pump 40. As shown, the toner sensor 15 outputs a signal (ON) representative of toner when a preselected amount of toner is collected in the hopper portion 21. In response, the air pump 40 is turned on (ON), and on the elapse of 0.5 second the screw pump 30, i.e., the rotor 32, is turned on (ON). At this instant, the MPU 14 causes the screw pump 30 to remain in its ON state for a preselected period of time (2 seconds in the illustrative embodiment) and then go to its OFF state.

Also, the MPU 14 causes the air pump 40 to go to its OFF state on the elapse of 5 seconds since the turn-off of the screw pump 30.

With the above control, it is possible to cause the toner, if left in the tubing 35 after the turn-off of the screw pump 30, to be surely conveyed to the developing unit 4 by air. This reduces the toner to remain in the tubing 35 and thereby obviates an occurrence that the toner stops up the tubing 35.

Usually, after the stop of rotation of the rotor 32, the toner sensor or powder pressure sensor 15 is expected to output a signal representative of the absence of the collected toner. However, if the amount of the collected toner does not decrease due to defective conveyance ascribable to, e.g., the fault of the screw pump 30, then the output of the toner sensor 15 will continuously indicate the presence of the collected toner. In this case, the MPU 14 determines that the toner conveyance is defective, and activates an alarm unit 16 (see FIG. 2). As a result, an alarm message appears on an alarm display panel, not shown, provided on the copier while the copier stops operating.

Figure 6:
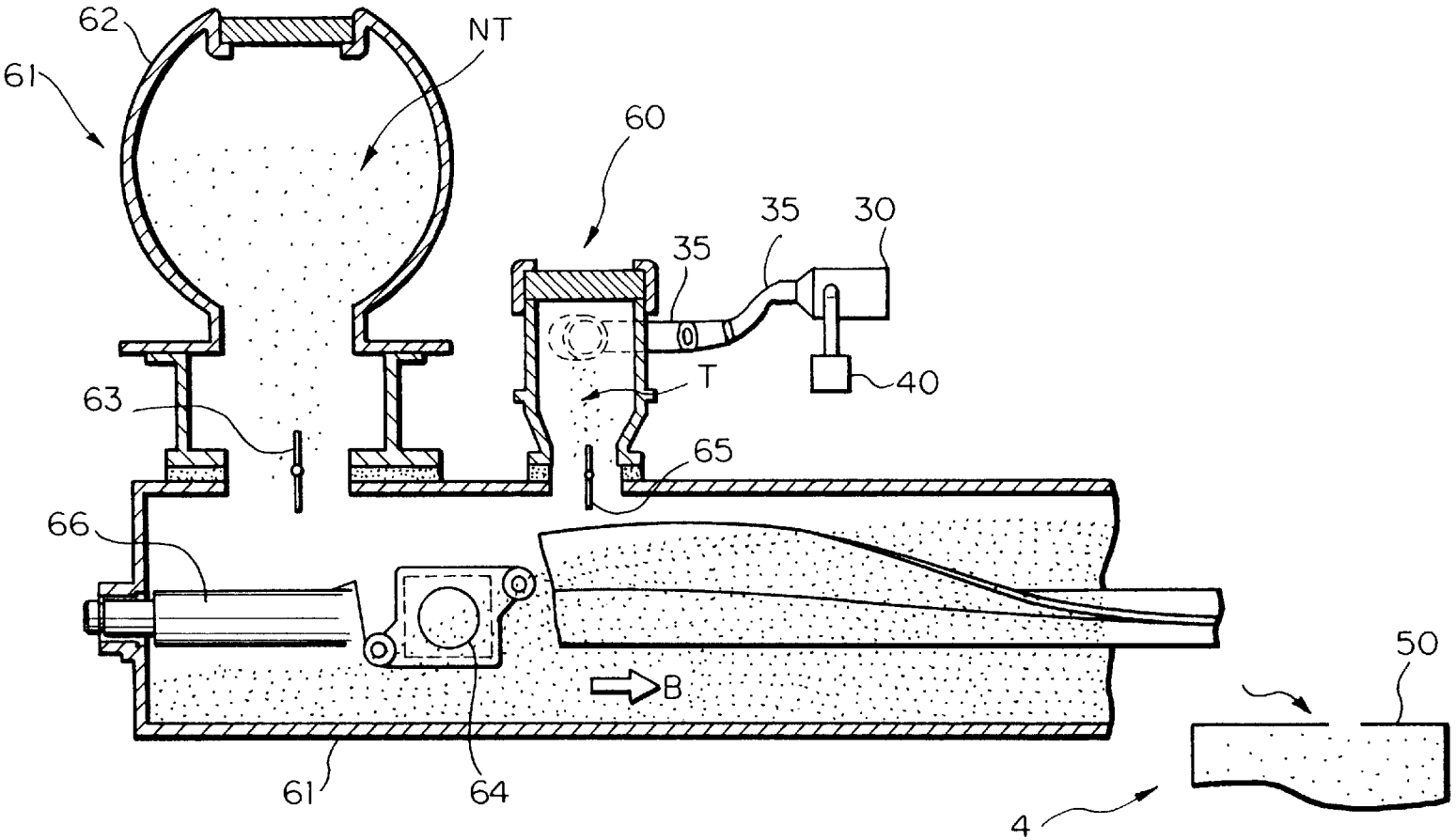
FIG. 6 is a section showing a toner replenishing section also included in the first embodiment.

FIG. 6 shows a specific configuration of a collected toner feeding unit 60 and a fresh toner feeding unit 61 each of which feeds the respective toner to the developing unit 4. As shown, the collected toner feeding unit 60 is connected to the toner conveying device 20 by the tubing 35. The collected toner, labeled T, is conveyed via the tubing 35 by the screw pump 30 in the form of an air-toner mixture, as stated earlier. The fresh or new toner, labeled NT, is stored in a toner container 62 included in the toner feeding unit 61. To feed the fresh toner NT to the toner hopper 51, a blade 63 included in the unit 61 is operated first. When a sensor 64 senses the toner NT fed into the toner hopper 51 by the blade 63, a blade 65 included in the other unit 60 is operated in order to feed the collected toner T into the toner hopper 51. The fresh toner NT and collected toner T are conveyed together in a direction B while being agitated by a screw 66. The mixture of the toner NT and toner T is replenished into the casing 50 of the developing unit 4 and reused as recycled toner capable of implementing high image quality.

The collected toner feeding unit 60 is positioned downstream of the fresh toner feeding unit 61 in the direction of toner conveyance. The screw beneath the two units 60 and 61 conveys the fresh toner NT and collected toner T in the direction B, FIG. 6, while agitating them together. The tubing 35 is connected to the unit 60 in order to feed the collected toner to the unit 60. The MPU 14 controls the amount of the collected toner to be fed to the unit 60 by controlling the screw pump 30 and/or the air pump 40 or by controlling the rotation of the blade 65. Also, the MPU 14 controls the amount of the fresh toner to be fed to the unit 61 by, e.g., controlling the rotation of the blade 63.

In the above configuration, it is difficult to set the preselected amount of toner in the hopper portion 21 which causes the screw pump 30 to start operating. Specifically, the fluidity of the collected toner is low because the toner is scraped off by the cleaning blade and caused to cohere and because the toner has its temperature raised by frictional heat. Should such toner accumulate in the hopper portion 21 in an excessive amount, it would not be conveyed from around the screw 23 and would easily bridge above the screw 23. As a result, the collected toner would fill up the hopper portion 21 and therefore the cleaning unit, rendering cleaning defective or overflowing via the nip of the drum 1.

Figure 7:
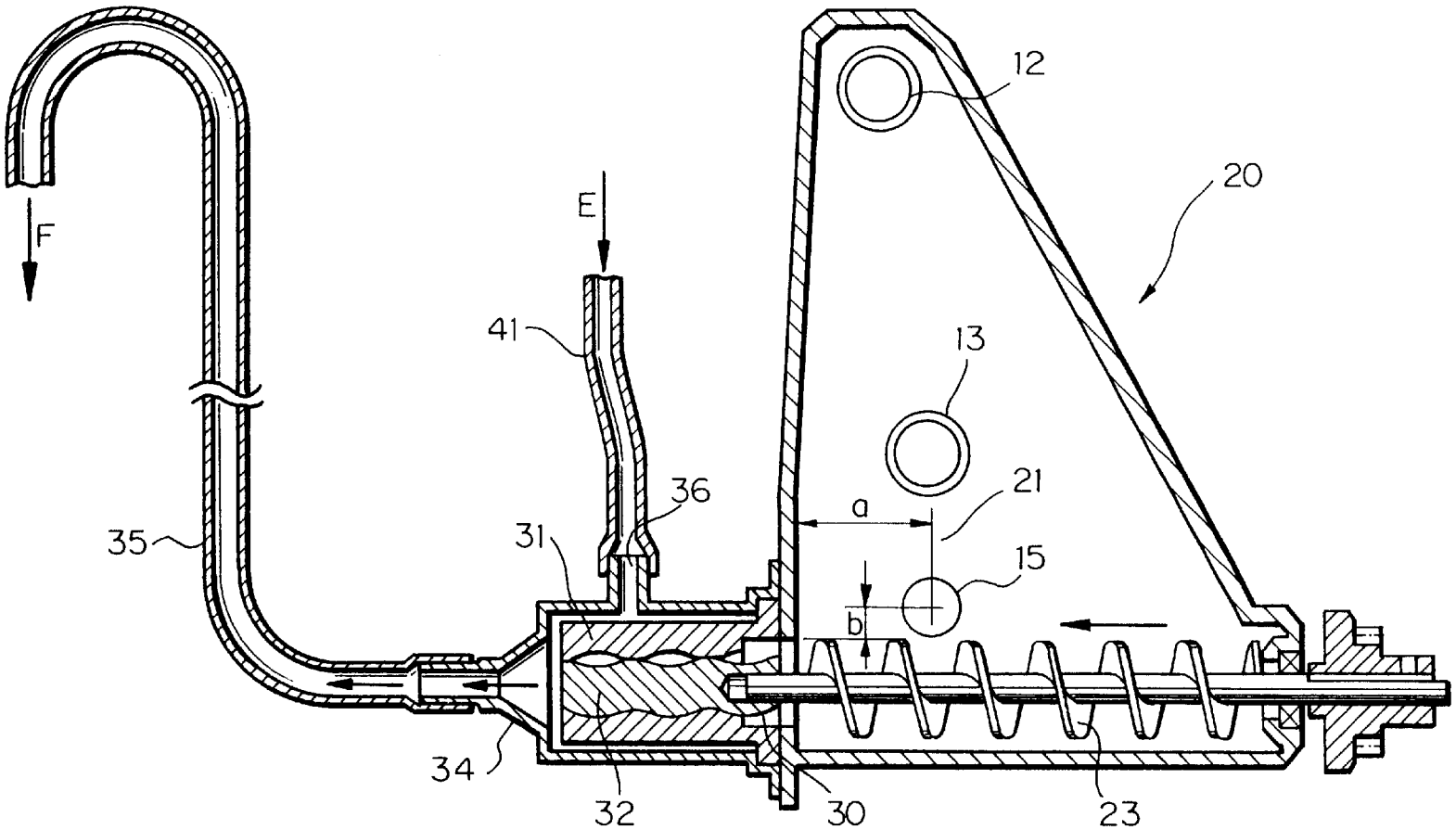
FIG. 7 is a section showing another specific configuration of the toner conveying device.

FIG. 7 shows a modification of the first embodiment constructed to solve the above problem. As shown, the toner sensor 15 is so positioned as to sense an amount of collected toner only great enough to bury the toner inlet of the screw pump 30 therein. Specifically, the toner sensor 15 is spaced from the stator 31 by a distance $\alpha$ of 20 to 30 mm and spaced above the top of the toner inlet of the stator 31 by a distance b of 0 to 10 mm.

The collected toner is conveyed in response to the output of the toner sensor 15 responsive to the amount of collected toner burying the toner inlet of the screw pump 30, as stated above. In this condition, the collected toner seals the inlet of the screw pump 30 and exerts resistance against the reverse flow of air. This obstructs the certain degree of reverse flow of air and thereby increases the margin of the screw pump 30.

In the illustrative embodiment and its modification, the toner conveying device 20 is operated in response to the output of the toner sensor 15 representative of the preselected amount of toner existing in the hopper portion 21 and is operated intermittently. Alternatively, the intermittent drive of the device 20 may be effected on the basis of any suitable factor indicative of the increase of the toner in the hopper portion 21 to the preselected amount, as will be described with reference to FIGS. 8 and 9 hereinafter.

Figure 8:
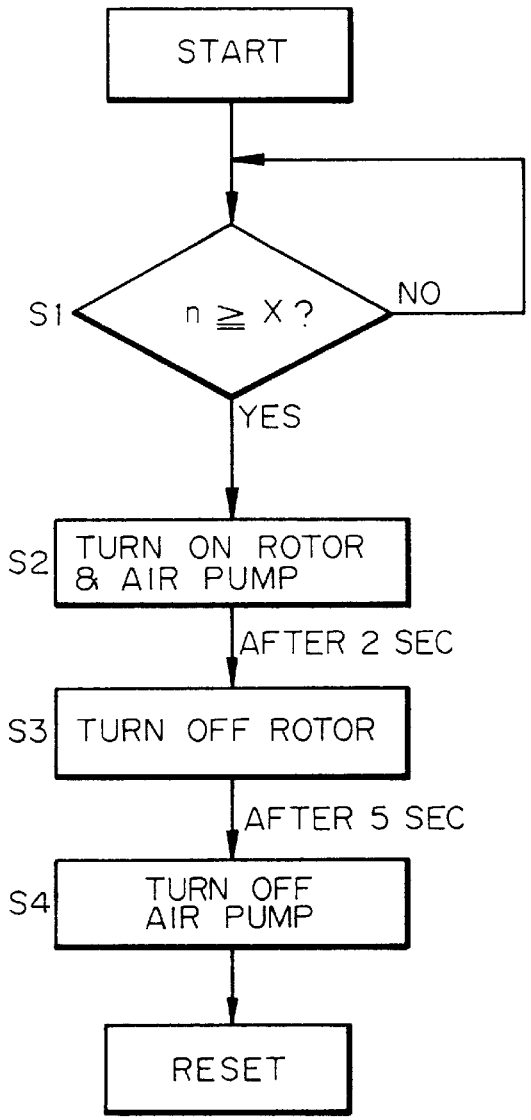
FIG. 8 is a flowchart demonstrating a specific operation of a modification of the first embodiment.

FIG. 8 shows a specific case wherein the intermittent drive of the toner conveying device 20 is effected on the basis of the number of copies produced. A counter, not shown, is included in the copier for counting copies sequentially produced by the copier. The MPU 14 determines, based on a count output from the counter, whether or not the number of copies n actually produced has reached a preselected number X (step S1). If the answer of the step S1 is positive (YES), the MPU 14 turns on the screw pump 30, i.e., the rotor 32 and the air pump 40 (step S2). Then, on the elapse of 2 seconds, the MPU 14 turns off the rotor 32 (step S3). On the elapse of 5 seconds since the turn-off of the rotor 32, the MPU 14 turns off the air pump 40 so as to end the toner conveying operation.

Figure 10:
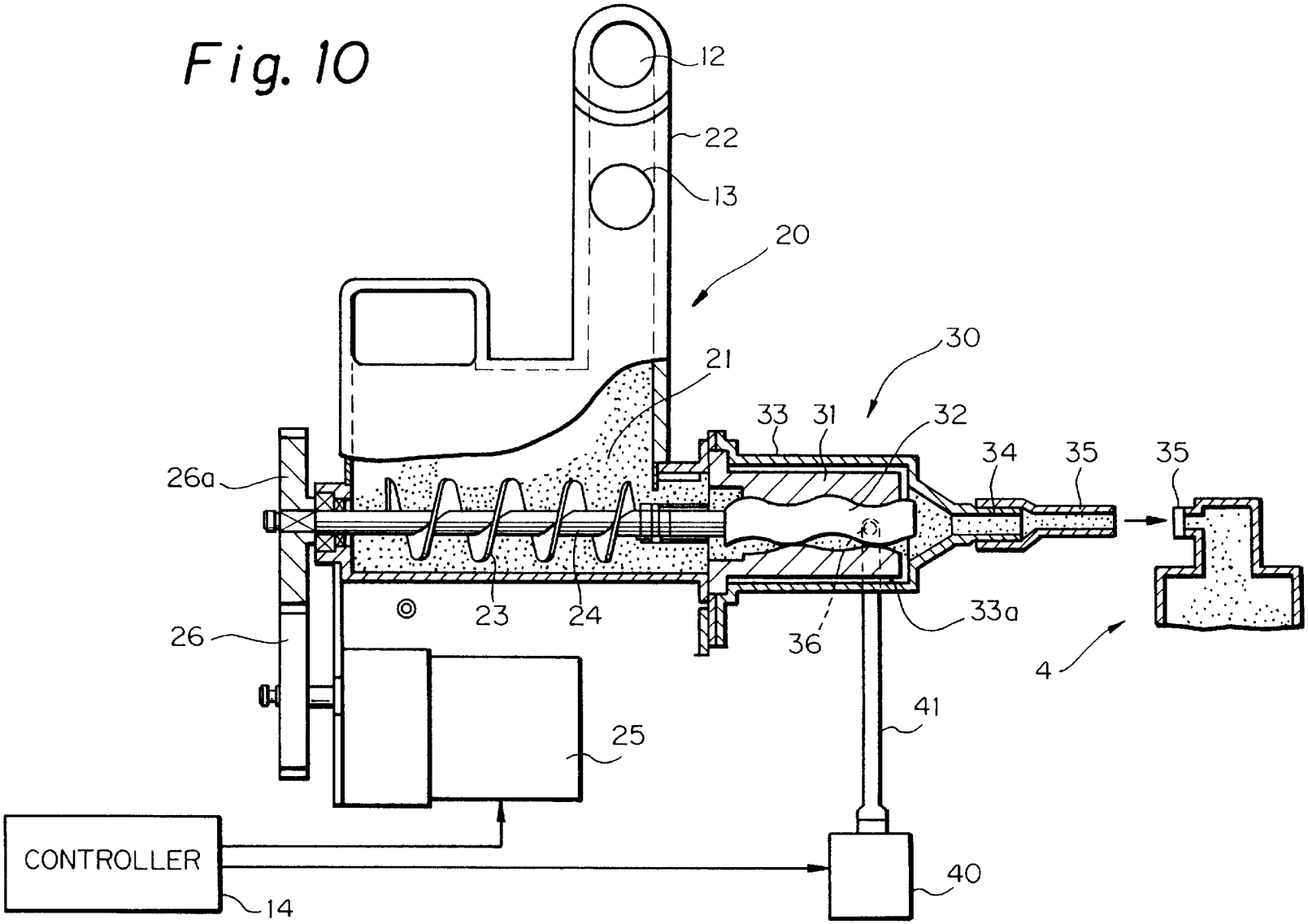
FIG. 10 is a section showing still another specific configuration of the toner conveying device.

Specifically, the mean amount of toner to be consumed by a unit number of copies is generally constant, and about 10% of the toner is collected. It is therefore possible to determine the amount of toner to accumulate in the hopper portion 21 and therefore to control the toner conveying device 20 on the basis of the number of copies produced. This configuration eliminates the need for the toner sensor 15, as shown in FIG. 10 corresponding to FIG. 2, and thereby reduces the cost of the image forming apparatus.

Figure 9:
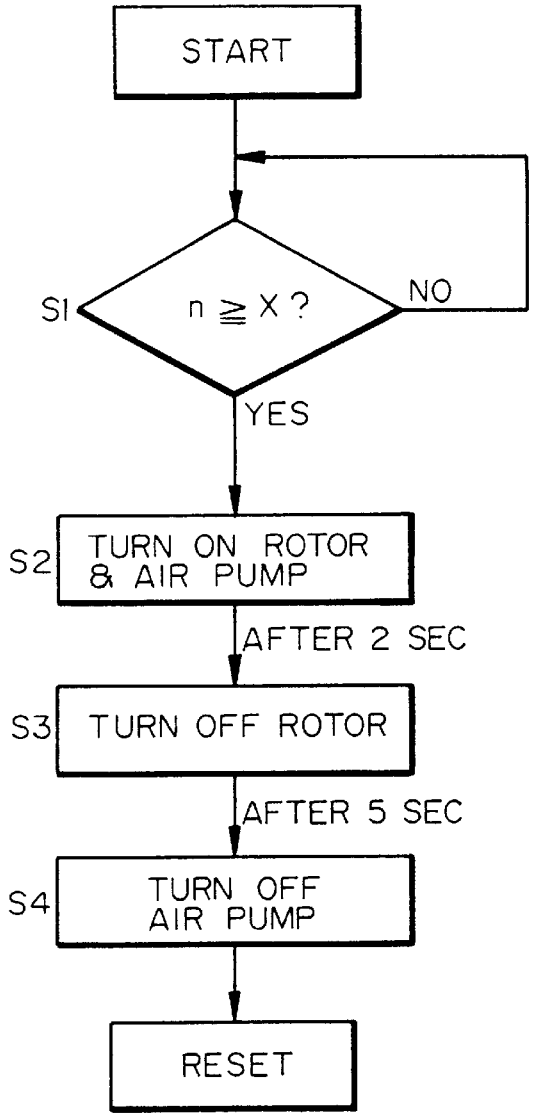
FIG. 9 is a flowchart showing a specific operation of another modification of the first embodiment.

While the above scheme using the number of copies as a factor for decision is desirable for, e.g., a page printer printing almost only characters, it is not desirably applicable to an image forming apparatus of the type forming many solid images due to a substantial scatter. FIG. 9 shows another specific procedure which uses, to solve the above problem, a signal representative of the number of pixels for writing a latent image on the drum 1. As shown, the MPU 14 receives a count representative of the number of pixels from pixel detecting means included in the copier, and determines whether or not the actual number of pixels n has reached a preselected number of pixels X (step S1). If the answer of the step S1 is YES, the MPU 14 turns on the rotor 32 of the screw pump 30 and the air pump 40 (step S2). On the elapse of 2 seconds, the MPU 14 turns off the rotor 32 (step S3) and then turns off the air pump 40 on the elapse of 5 seconds. Such control over the toner conveying device 20 allows the amount of collected toner to be more surely determined and enhances stable control.

While the above embodiment and its modifications each return the collected toner to the developing unit 4, the collected toner may be delivered to a toner bank associated with the unit 4 and storing fresh toner. In such a case, the collected toner will be mixed with the fresh toner in the toner bank and then fed to the developing unit 4. Of course, only the toner collected by either one of the drum cleaning unit 6 and belt cleaning unit 11 may be returned to the developing unit 4 or the toner bank. Particularly, the toner collected by the belt cleaning unit 11 may be returned to a waste toner tank without being recycled because it contains paper dust and other impurities.

The illustrative embodiment and its modifications have various unprecedented advantages, as enumerated below.

(1) The intermittent drive reduces the operating time and therefore temperature elevation ascribable to friction between the rotor and the stator of the screw pump, compared to continuous drive. This successfully obviates the blocking and deterioration of the collected toner. In addition, the operating time of the screw pump is noticeably reduced, compared to continuous operation, so that the life of the pump is extended. This advantage is also achievable when a toner sensor is absent.

(2) Even if the toner is left in the tubing after the stop of the screw pump, it is surely conveyed toward the developing unit by air. This reduces the amount of toner to remain in the tubing and prevents the toner from stopping up the tubing.

(3) The collected toner accumulating at a position upstream of the screw pump blocks the inlet of the screw pump and thereby obviates air leakage. Therefore, the conveying ability of the screw pump is preserved even when the stator has its inside diameter slightly increased.

(4) An error in the toner conveyance by, e.g., the screw pump can be easily detected without resorting to any special sensor.

(5) The screw pump and air pump can be controlled on the basis of the number of copies produced.

(6) Recycling the collected toner is effective to obviate the waste of toner and reduce the running cost of the copier.

2nd Embodiment

Figure 11:
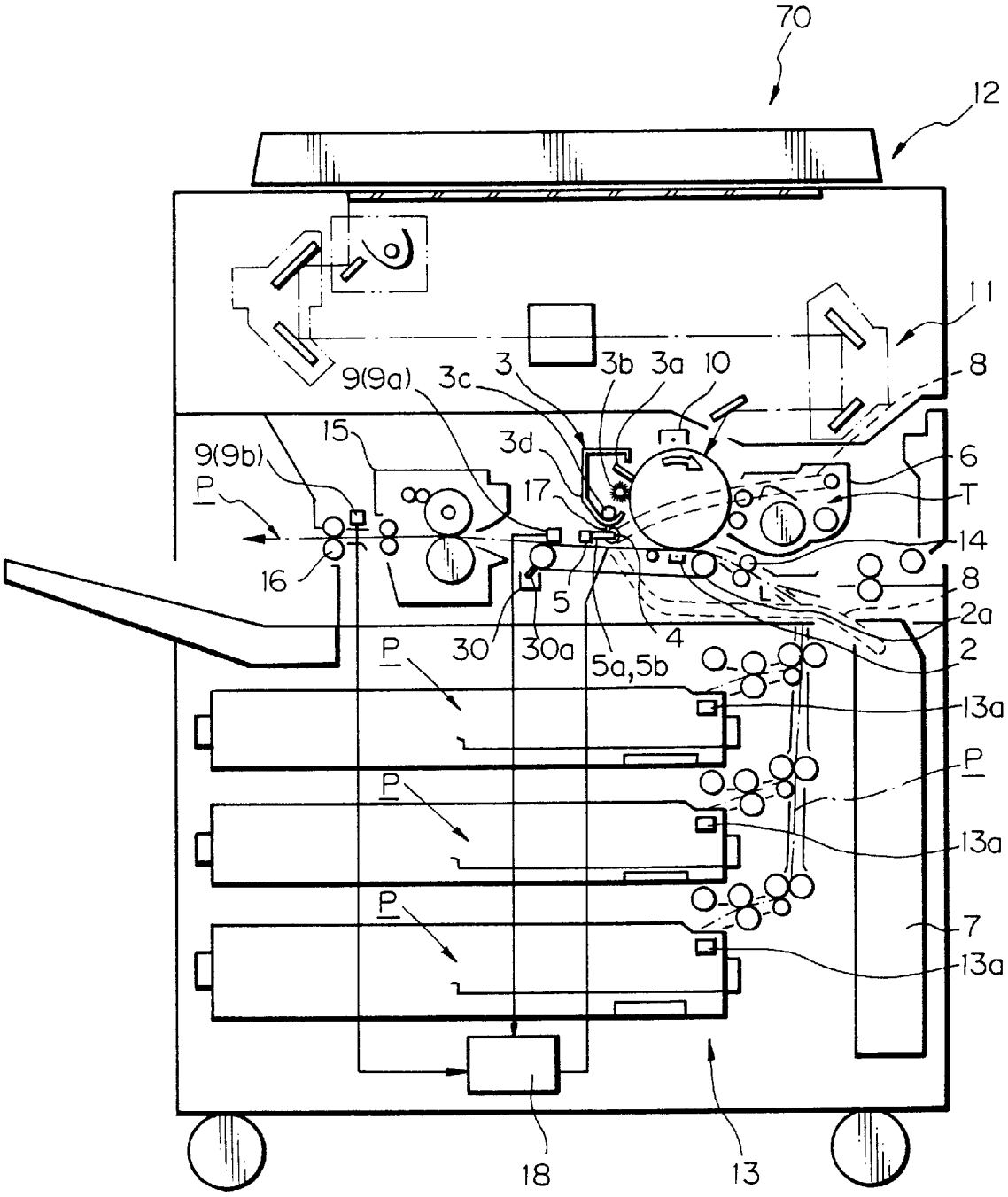
FIG. 11 shows the general construction of a second embodiment of the image forming apparatus in accordance with the present invention.

Referring to FIG. 11, a second embodiment of the present invention will be described. As shown, an image forming apparatus also includes the photoconductive drum 1 rotatably supported by opposite side walls, not shown. The drum 1 is rotated clockwise, as indicated by an arrow A, by drive means, not shown. After the drum 1 has been uniformly charged by a charger 10, a latent image is formed on the drum 1 by optics 11 by the previously stated electrophotographic procedure. The latent image is developed by the developing unit 6. The drum 1 may be replaced with an endless photoconductive belt, if desired. If the optics 11 is replaced with laser optics, not shown, including a laser and a deflector, then the apparatus turns out a laser printer capable of optically writing an image in the drum 1 in accordance with an image signal. Further, a document reading device or scanner 12 may be included in the apparatus in order to implement a digital copier or a facsimile apparatus.

A paper P of size A4, which is the standard size, is fed from a paper feed section 13 to a nip between the drum 1 and an image transfer device 2 via a registration roller 14 while having its size sensed by a size sensor 13*a*. The image transfer device 2 transfers the toner image from the drum 1 to the paper P. The paper P with the toner image is conveyed to a fixing unit 15 by a transfer belt 2*a*. After the toner image has been fixed on the paper P by the fixing unit 1, the paper P is driven out of the apparatus to, e.g., a tray by an outlet roller 16.

A drum cleaning unit 3 has a cleaning blade 3*a* and a brush roller 3*b* for scraping off the toner left on the drum 1 after the image transfer. The toner collected by the cleaning unit 3 is conveyed by a coil 3*c* and then dropped via an outlet 3*d* due to its own weight. Then, the toner is conveyed to a powder screw pump or air stream conveying means 4 by a toner guide 17 as collected or recycled toner T.

A belt cleaning unit 30 includes a cleaning blade 30a and removes the toner left on the image transfer device 2 (transfer belt 2*a*) contacting the drum 1 with the cleaning blade 30*a*. The toner collected by the belt cleaning unit 30 is also conveyed to the screw pump 4 as collected toner, although not shown specifically. Of course, the blade 30*a* of any one of the cleaning units 3 and 30 may be replaced with a magnet brush, fur brush or the like. Such a cleaning unit is similarly applicable to, e.g., an intermediate transfer belt intervening between a photoconductive drum and a paper or a transfer belt for conveying a paper to an image transfer position.

The screw pump 4 constitutes a toner recycling mechanism. An air pump or air-toner mixture feeding means 5 has its delivery port 5*a* communicated to the screw pump 4 by a tubing 5*b*. The air-toner mixture is delivered from the air pump 5 to a developing unit 6 or a waste toner container 7 by a mixture delivery path 8 implemented by an elastic tubing or a hard piping. The waste toner tank 7 is removably mounted on the apparatus body independently of the developing unit 6.

A sensing device 9 senses the paper P of, e.g., size A4 to which the toner image has been transferred by the image transfer device 2, and thereby counts such papers P. For this purpose, the sensing device 9 has a sensor 9*a* located on a transport path adjoining the image transfer device 2 or a sensor 9*b* located on a transport path adjoining the outlet roller 16. The sensors 9*a* and 9*b* each is responsive to a reflection from the paper P. When the number of papers P reaches a preselected number n, as determined by the sensing device 9, an MPU 18 causes the screw pump 4 to start conveying the collected toner, continue it over a preselected period of time, and then stop the conveyance. That is, the screw pump 4 does not continuously operate.

In the above toner recycling mechanism, the toner collected by the cleaning unit 3 or 30 is conveyed by the screw pump 4 in the form of an air-toner mixture. Therefore, only if the tubing or piping constituting the mixture delivery path 8 and a cable for control are arranged, the collected toner can be delivered to the developing unit 6 or the waste toner container 7 independent of the developing unit 6. This promotes the effective use of a limited space available in the apparatus, enhances productivity, efficient maintenance and miniaturization, and obviates defective toner conveyance ascribable to, e.g., a coil screw while satisfying the cleaning quality, ability and function of the cleaning unit 3. In addition, the toner conveying force is maintained constant despite the aging of the screw pump 4, so that the apparatus needs a minimum of replacement of its constituent parts and is therefore low cost.

Figure 12:
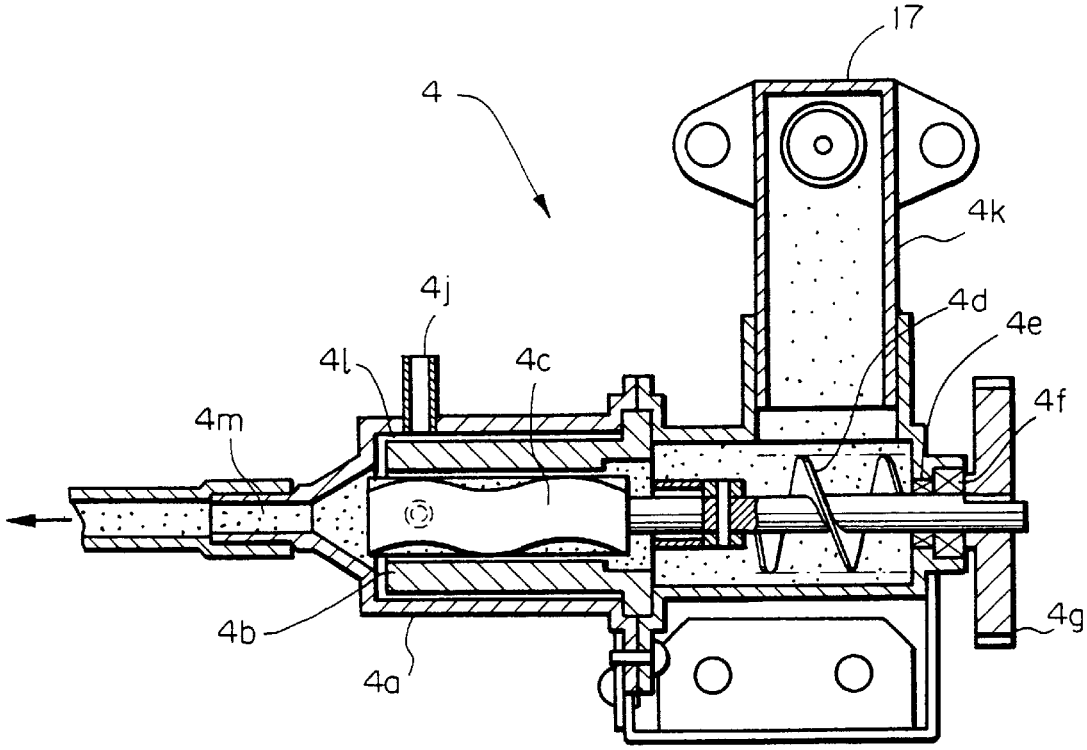
FIG. 12 is a section showing air stream conveying means included in the second embodiment.

FIG. 12 shows a specific configuration of the air stream conveying means. As shown, the air stream conveying means is implemented as a powder screw pump or Mono pump consisting of a hollow cylindrical holder 4*a*, a female screw type stator 4*b* formed of rubber or similar elastic material, and a male screw type rotor 4*c* rotatably received in the stator 4*b*. The rotor 4*c* is engaged with one end of a screw 4*d* for horizontal conveyance. The other end of the screw 4*d* is engaged with a driven gear 4*g*, sealed by a seal member 4*e*, and rotatably supported by a bearing 4*f*. A hopper 4*k* is engaged with a toner guide member 17. A gap 41 of about 1 mm is formed between the outer periphery of the stator 4*b* and the inner periphery of the holder 4*a* and communicated to a passage 4*m*. An air inlet 4*j* is formed in the holder 4*a* in order to send air under pressure into the passage 4*m*.

Figure 13:
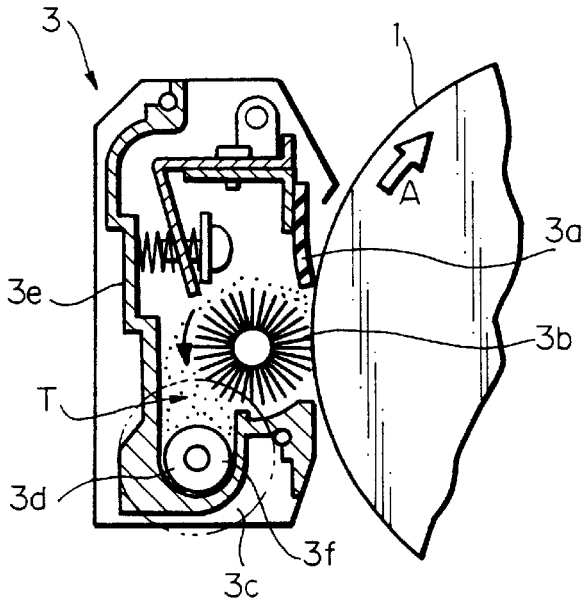
FIG. 13 shows a cleaning unit also included in the second embodiment.
Figure 14:
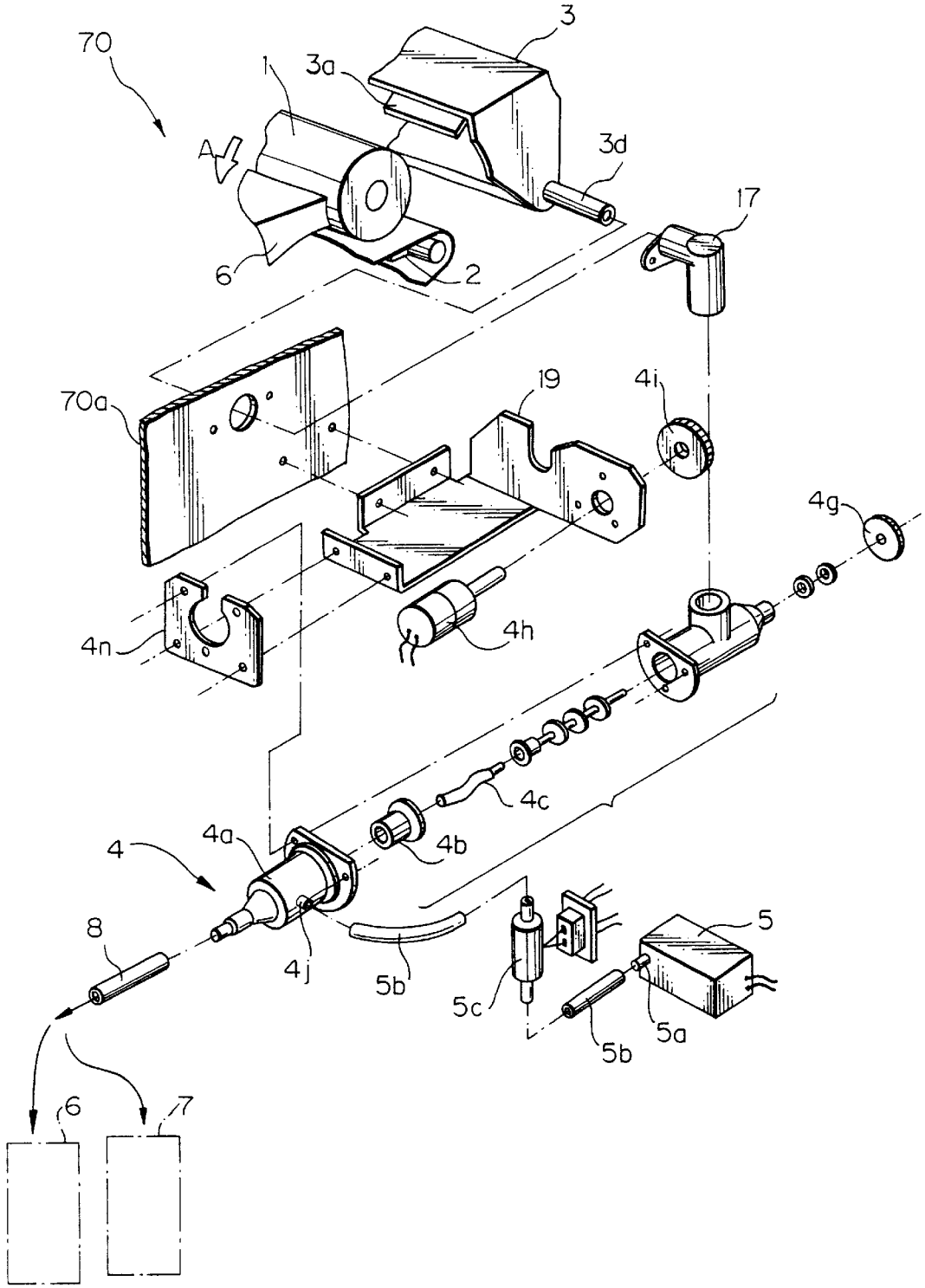
FIG. 14 is an exploded perspective view showing the air stream conveying means of FIG. 13 together with air feeding means and other arrangements.
Figure 15:
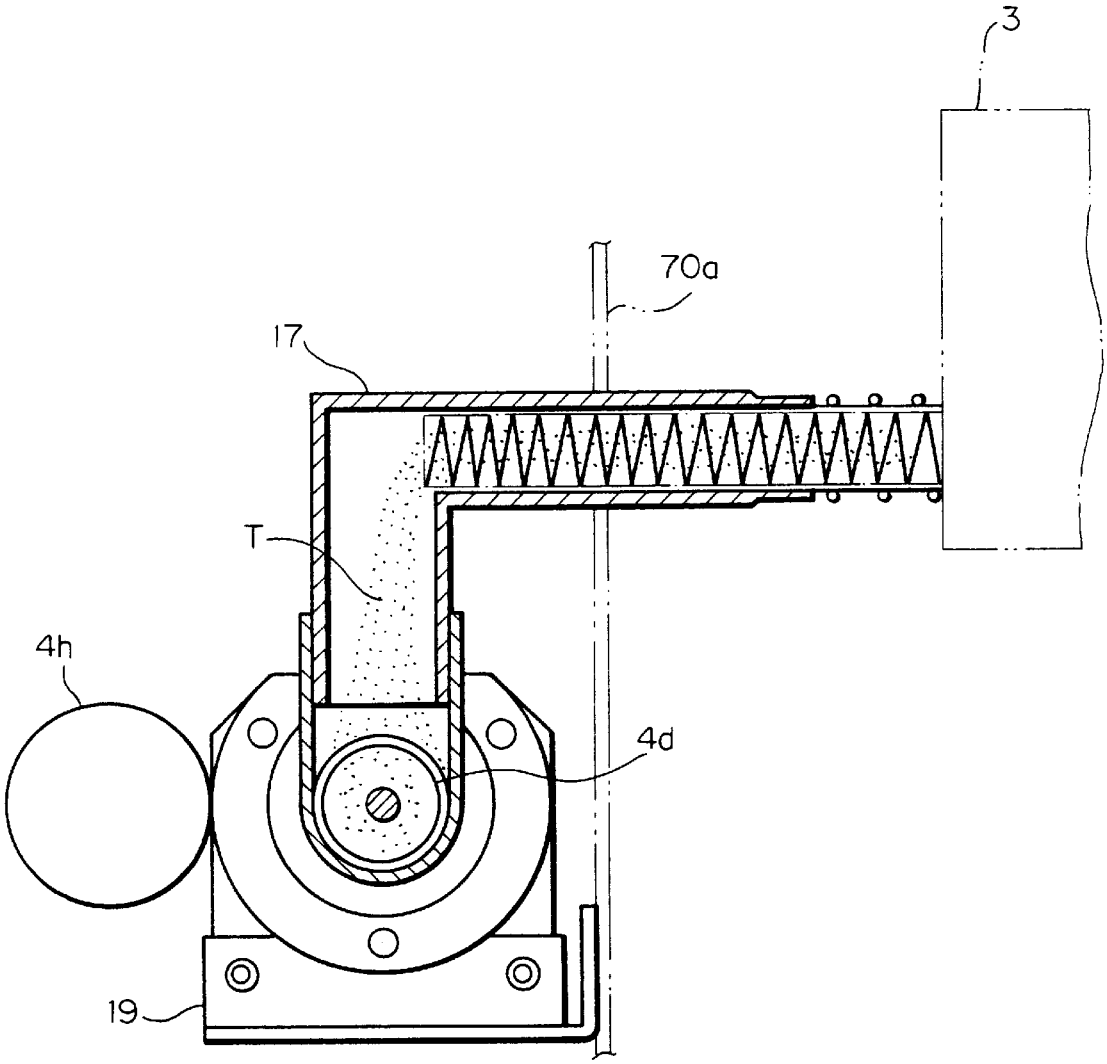
FIG. 15 shows a toner guide member also included in the second embodiment.
Figure 16:
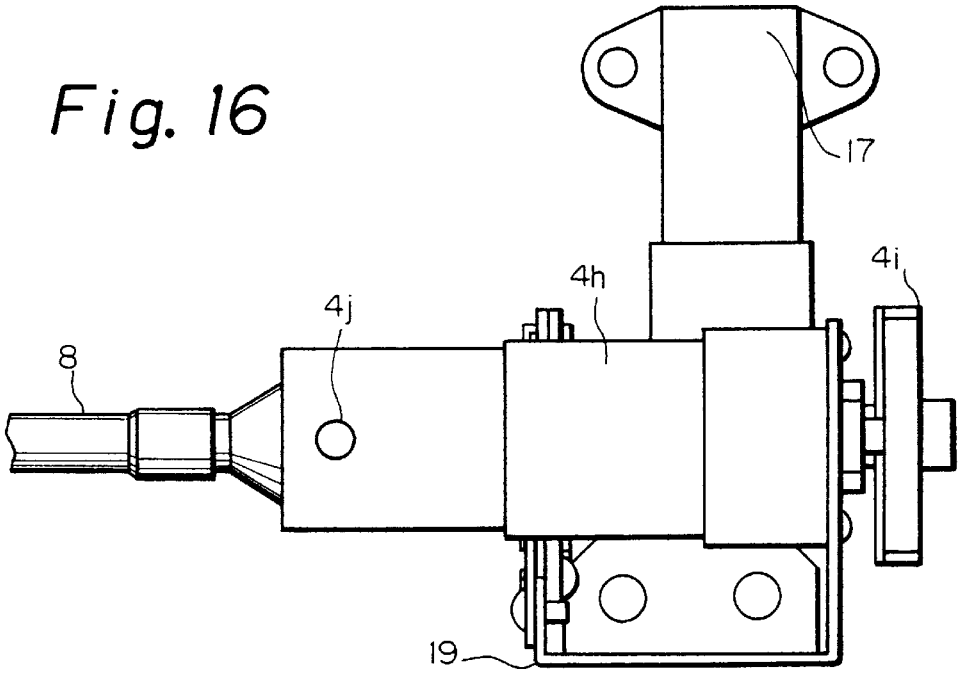
FIG. 16 is an external view of the air stream conveying means of the second embodiment.

FIG. 13 shows a specific configuration of the drum cleaning unit 3. FIG. 14 is an exploded view showing the drum cleaning unit 3 and powder screw pump 4. FIG. 15 is a section showing a specific configuration of the toner guide member 17. Further, FIG. 16 is an external view of the powder screw pump 4. As shown in FIG. 13, the cleaning blade 3*a* and brush roller 3*b* of the cleaning unit 3 scrape off the toner left on the drum 1 after image transfer while the drum 1 is rotated clockwise as indicated by an arrow A. The toner removed from the drum 1 is collected in a casing 3*e* playing the role of the structural body of the cleaning unit 3 and a toner guide member at the same time. A toner discharge member 3*f* adjoining the bottom of the casing 3*e* conveys the toner to the toner guide member 17 via the outlet 3*d*.

As shown in FIG. 14, the apparatus body, labeled 70, includes a structural portion 70*a* which is a side wall on the drive side. The drum or image carrier 1, image transfer device 2, cleaning unit 3, powder screw pump or air stream conveying means 4, air pump or air feeding means 5 and other image forming members are mounted on the structural portion 70*a*. The screw pump 4 is mounted on a support member 19 via a mounting member 4*n*. A drive motor 4*h* is mounted on the support member 19. A drive gear 4*i* is mounted on the output shaft of the drive motor 4*h* and held in mesh with the driven gear 4*g*. The air pump 5 is positioned outside of the support member 19 and has its delivery port 5*a* communicated to the air inlet 4*j* (see FIG. 12) by a tubing 5*b* and an air sensor 5*c*. The air inlet 4*j* is communicated to the passage 4*m* mentioned earlier.

The air pump 5 delivers air under pressure into the toner via the air inlet 4*j* at a rate of about 0.5 to 1.0 litter per minute. This air enhances the fluidity of the collected toner to be delivered from the screw pump 4 and thereby further insures the toner conveyance by the screw pump 4. The collected toner from the screw pump 4 is delivered to the developing unit 6 or the waste toner tank 7 via the mixture delivery path 8.

The mixture delivery path 8 should preferably be formed of soft vinyl chloride, nylon, teflon or similar flexible material resistive to toner. Such flexible connection between the screw pump 4 and, e.g., the developing unit 6 reduces limitations on the positional relation between the apparatus body and the various units and thereby promotes the effective use of a space for installation while facilitating maintenance.

If desired, the mixture delivery path 8 may be divided into a plurality of portions and connected in any suitable combination. Likewise, the air feed tubing 5*b* of the air pump 5 may be divided into a plurality of portions and connected in any suitable combination. Such a configuration will allow the various devices to be constructed into units and will increase productivity and enhance maintenance.

The distance over which the collected toner is to be conveyed can be set on the basis of the sizes of the rotor 4*c* and stator 4*b* constituting the screw pump 4 as well as the rotation speed of the rotor 4*c*. In addition, the collected toner may be conveyed in any desired direction, i.e., upward, downward, rightward or leftward.

When the number of papers P each carrying a toner image thereon reaches a preselected number, as determined by the sensor 9*a* or 9*b*, the MPU 18 drives the drive motor 4*h* and air pump 5, as stated earlier. In the illustrative embodiment, the MPU 18 initially turns on only the air pump 5 and then turns on the drive motor 4*h* also on the elapse of several seconds. Subsequently, the MPU 18 turns off the drive motor 4*h* and continuously drives only the air pump 5 for several more seconds.

Specifically, while the screw pump 4 is in operation, the collected toner substantially evenly mixed with air fills substantially the entire mixture delivery path or tubing 8. In this condition, assume that both the screw pump 4 and air pump 5 are turned off. Then, air comes out of the air-toner mixture filling the path 8 with the result that the toner drops due to its own weight and increases its bulk density. When collected toner is newly fed in order to turn on the screw pump 4, the toner with high bulk density and remaining in the path 8 is likely to obstruct the conveyance of the new collected toner and stop up the path 8. This causes the screw pump 4 to lock or stick and causes the collected toner to stick to the rotor 4*c* due to excessive temperature elevation. The toner stuck to the rotor 4*c* shaves the stator 4*b* and thereby damages the screw pump 4.

In the illustrative embodiment, the air pump 5 is driven earlier than the screw pump 4 at the initial stage of operation, as stated previously. Therefore, the collected toner with high bulk density can be driven out of the mixture delivery path 8 by air. Further, only the air pump 5 is operated after the turn-off of the screw pump 4 in order to substantially evacuate the path 8. The embodiment is therefore capable of preventing the collected toner from stopping up the path 8 and thereby insuring more positive toner conveyance.

While the screw pump 4 is driven by the exclusive drive motor 4*h*, the pump 4 may be operatively connected to a driveline, not shown, included in the apparatus body 70 via, e.g., a clutch. This kind of configuration will further miniaturize, simplify and reduce the cost of the apparatus.

Figure 17:
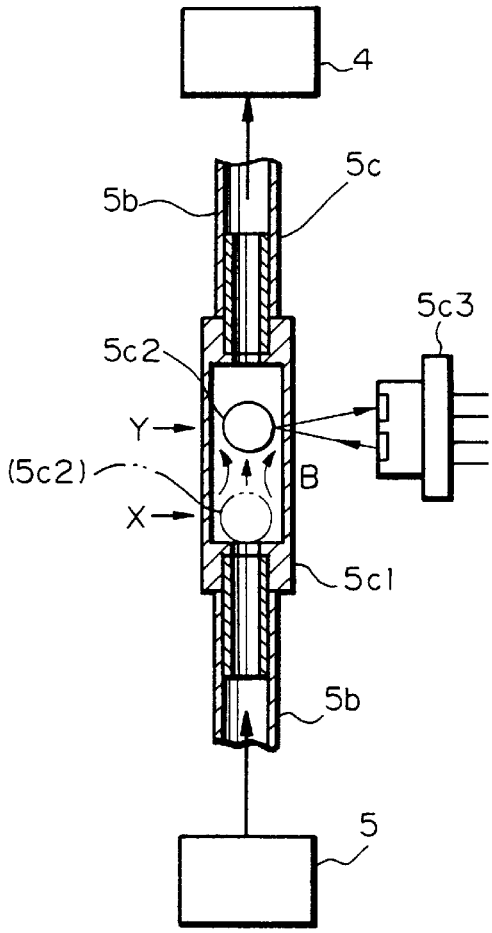
FIG. 17 is a section showing an air sensor also included in the second embodiment.

FIG. 17 shows a specific configuration of the air sensor 5*c* for determining whether or not air under pressure is being fed from the air pump 5 to the screw pump 4. In this sense, the air sensor 5*c* plays the role of a safety device for minimizing the system-down of the apparatus. As shown, the air sensor 5*c* includes a transparent container 5*c*1 whose both ends are connected to the tubing 5*b*. A float 5*c*2 is sealed in the container 5*c*1. When air under pressure is introduced into the container 5*c*1 in a direction B due to the operation of the air pump 5, it raises the float 5*c*2 from a position X to a position Y, as illustrated. A sensor 5*c*3 is implemented by a reflection type photosensor. When the sensor 5*c*3 senses the float 52*c* brought to the position Y, it determines that air is being fed from the air pump 5 to the screw pump 4.

Assume that the sensor 5*c*3 does not sense the float 5*c*2 at the position Y despite the operation of the air pump 5. Then, a controller, not shown, determines, based on the output of the sensor 5*c*3, that some error has occurred in the feed of air from the air pump 5 to the screw pump 4. Then, the controller stops the operation of the apparatus and displays an error message on a display, not shown.

The float 5*c*2 is implemented by, but not limited to, a ball formed of resin or stainless steel or similar metal. Of course, the reflection type sensor constituting the sensor 5*c*3 may be replaced with a transmission type sensor or a magnetic sensor.

Figure 18:
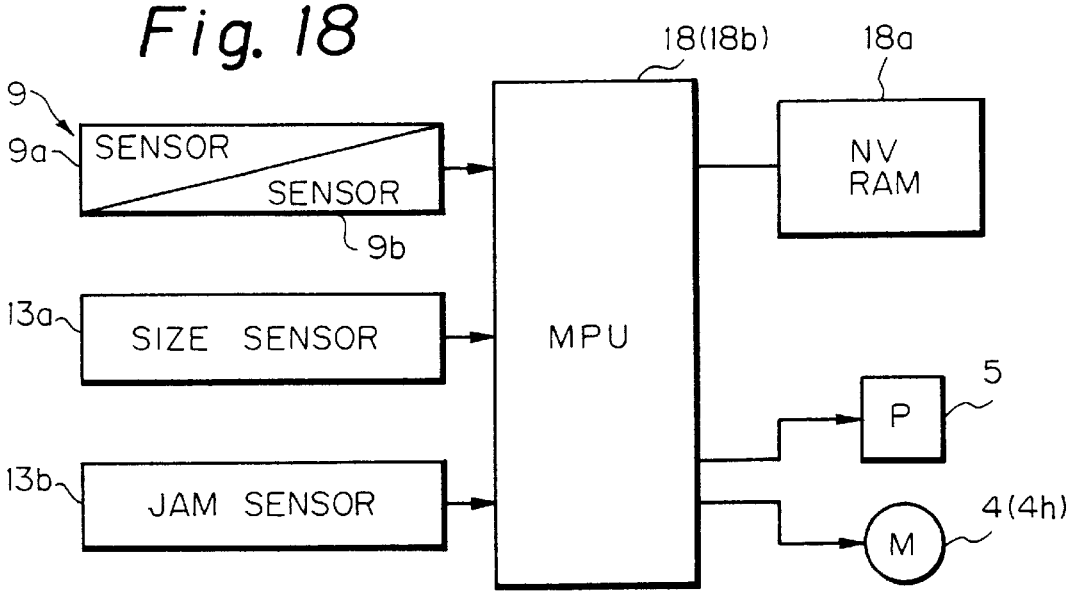
FIG. 18 is a block diagram schematically showing a control system particular to the second embodiment.

FIG. 18 shows a control system included in the illustrative embodiment. As shown, the MPU 18 receives from the sensor 9*a* or 9*b* data representative of the number of papers P to which toner images have been transferred, receives from the size sensor 13*a* data representative of the sizes of the papers P, and receives from a jam sensor 13*b* data representative of a paper jam. The MPU 18 controls the screw pump 4 and air pump 5 on the basis of such data. Every time the MPU 18 receives the output of the sensor 9*a* or 9*b*, it increments a counter 18*b* included therein by 1 (one).

When the counter 18*b* reaches the preselected number n, the MPU 18 clears the counter 18*b* and energizes the drive motor 4*h* for driving the screw pump 4 and the air pump 5. The MPU 18 additionally includes a timer and can energize each of the drive motor 4*h*, air pump 5 and so forth at a particular timing. An NV RAM (Nonvolatile Random Access Memory) 18*a* backs up the counter 18*b* in order to prevent the counter 18*b* from being cleared when a power switch, not shown, provided on the apparatus is turned off.

Figure 19:
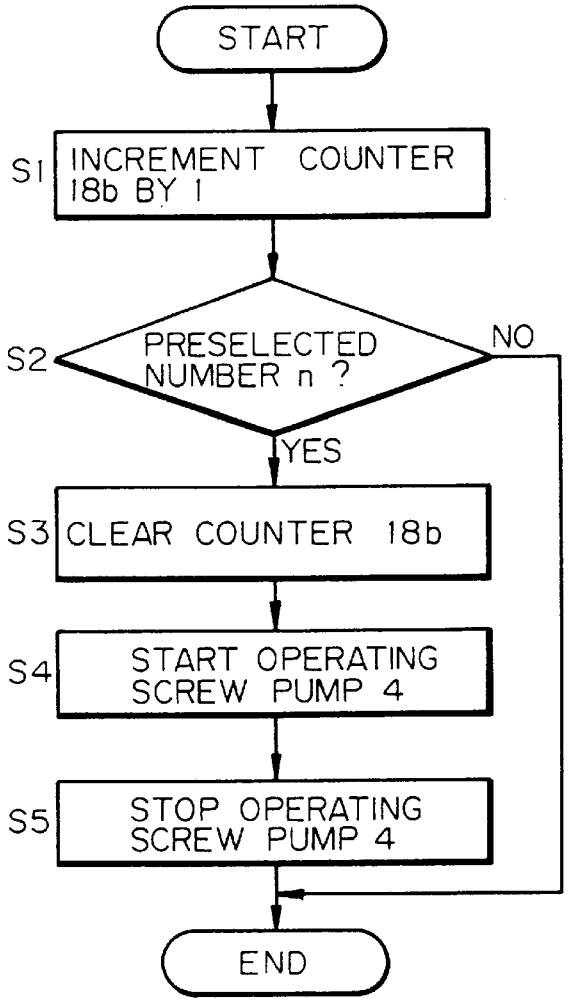
FIGS. 19 and 20 are respectively a flowchart and a timing charge demonstrating a specific operation of the second embodiment.

FIG. 19 shows a specific operation of the illustrative embodiment, i.e., the MPU 18. As shown, when the sensor 9*a* or 9*b* senses a paper P being conveyed, the MPU 18 increments its counter 18*b* by 1 in response to the resulting output of the sensor 9*a* or 9*b* (step S1). When the count output from the counter 18*b* reaches the preselected value n (Yes, step S2), the MPU 18 clears the counter 18*b* (step S3) and starts energizing the drive motor 4*h* and air pump 5 (step S4). Then, on the elapse of a preselected period of time, the MPU 18 stops the delivery of the collected toner (step S5).

Figure 20:
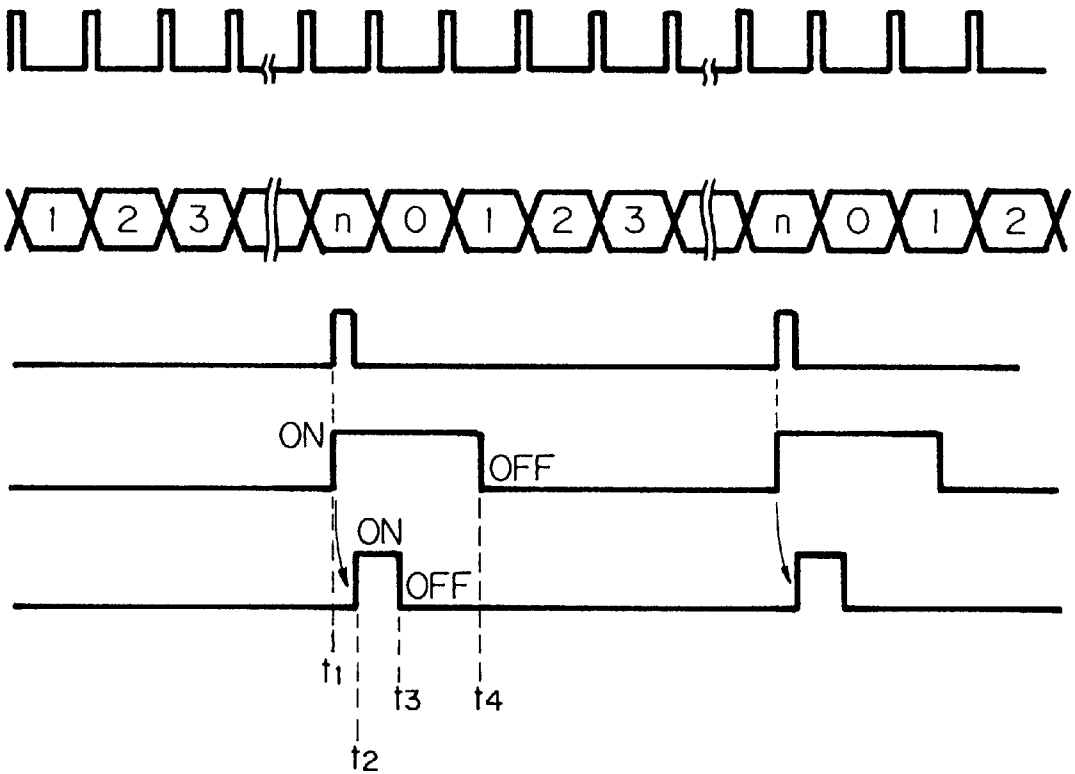

FIG. 20 is a timing chart representative of the operation of the embodiment. As shown, when the counter 18*b* of the MPU 18 reaches the preselected value n, the MPU 18 drives the air pump 5 at a time t1. Then, at a time t2 a preselected period of time later than the time t1, the MPU 18 energizes the drive motor 4*h* assigned to the screw pump 4. Subsequently, at a time t3 a preselected period of time later than the time t2, the MPU 18 stops energizing the drive motor 4*h*. Further, at a time t4 a preselected period of time later than the time t3, the MPU 18 stops driving the air pump 5. With this control, it is possible to discharge the toner tending to remain in the mixture delivery path 8 only by air, and therefore to prevent the path 8 from being stopped up.

The preselected value or count n can be adequately set by calculation. Specifically, the amount of toner collected for a unit time is determined by the amount of toner deposition on the paper P, image transfer ratio, copy speed, and so forth. The count n is the ratio of the maximum amount of toner conveyance (ability) available with the screw pump 4 for a unit time to the above amount of toner collected for a unit time. The amount of toner deposition on the paper P refers to the amount of toner deposition for a unit area of the drum or image carrier 1 multiplied by the area and document ratio of the paper or recording medium P. The area of the paper P may be the area of size A4 generally used most often while the document ratio may be 6% which is a mean value.

As for the size of the paper P, the size sensor 13*a* disposed in the paper feed section 13 senses the size of the paper P, as usual. An arrangement may be made such that when the size of the paper P is different from size A4, as determined by the size sensor 13*a*, the preselected count n is varied in order to enhance accurate decision on the amount of collected toner. For example, when the size of the paper P is greater than reference size A4, the preselected count n may be multiplied by a preselected coefficient, e.g., ½ in order to drive the screw pump 4 efficiently in accordance with the resulting change in the amount of collected toner. This successfully enhances the durability of the screw pump 4. The above coefficient is representative of the ratio of the actual paper size to the reference size A4.

Assume that a paper jam occurs on the paper transport path upstream of the image transfer device 3, as determined by the jam sensor 13*b*. Then, a great amount of toner deposited on the drum 1 remains on the drum 1 without being transferred to the paper P. Such toner is sometimes directly collected by the drum cleaning unit 3. In this case, the illustrative embodiment drives the screw pump 4 in such a manner as to deal with the great amount of toner coming in for a moment. Alternatively, the embodiment may multiply the preselected count n by, e.g., ⅕ for a moment in order to reduce the period at which the screw pump 4 is driven.

As stated above, the illustrative embodiment has various unprecedented advantages, as enumerated below.

(1) The toner collected by the cleaning unit is transferred in the form of an air-toner mixture, so that the drawback of, e.g., a coil screw is obviated. The toner conveying force can be stably maintained despite aging, reducing the frequency of replacement of parts and therefore the cost.

(2) There can be obviated a sharp decrease in the amount of bite between the rotor and the stator due to, e.g., the wear and creep of the stator slidingly contacting the rotor.

(3) The image forming apparatus including the toner recycling mechanism is reduced in size.

(4) Before the actual number of papers to which images have been transferred exceeds an allowable reference number, the collected toner is conveyed and prevented from stopping up the mixture delivery path or tubing.

(5) The collecting toner is prevented from stopping up the mixture delivery path over a long period of time.

(6) The conveyance of the collected toner can be controlled in accordance with the amount of toner actually collected. This maintains the toner conveying force stably in accordance with the paper size over a long period of time.

(7) The toner conveying force can be maintained stable by simple control in accordance with the paper size despite aging. In addition, even a great amount of collected toner ascribable to, e.g., a paper jam can be dealt with.

3rd Embodiment

Figure 21:
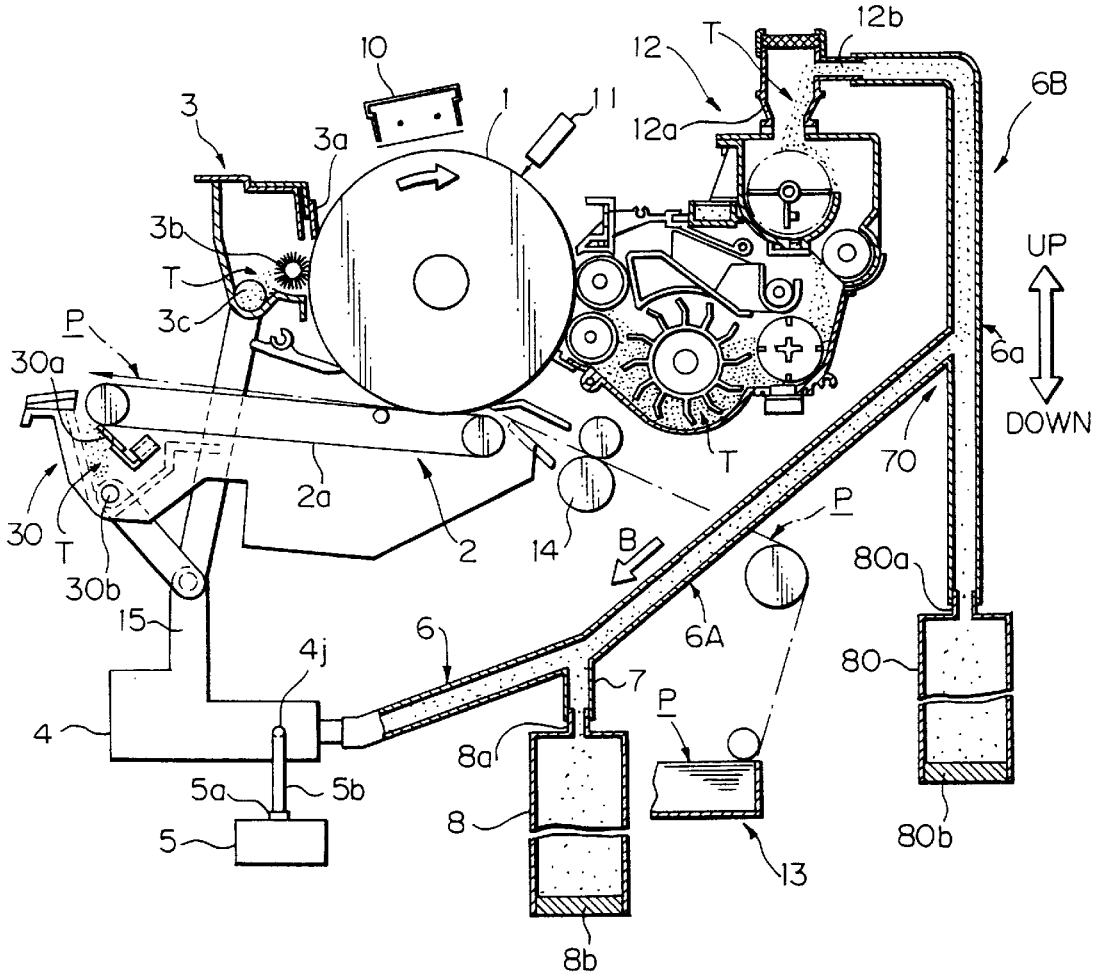
FIG. 21 shows a third embodiment of the image forming apparatus in accordance with the present invention.

Reference will be made to FIG. 21 for describing a third embodiment of the present invention. As shown, an image forming apparatus also includes the photoconductive drum 1 rotatably supported by opposite side walls, not shown. The drum 1 is rotated clockwise, as indicated by an arrow A, by drive means, not shown. After the drum 1 has been uniformly charged by a charger 10, a latent image is formed on the drum 1 by optics 11 by the previously stated electrophotographic procedure. The latent image is developed by a developing unit 12. If the optics 11 is replaced with laser optics, not shown, including a laser and a deflector, then the apparatus turns out a laser printer capable of optically writing an image in the drum 1 in accordance with an image signal. Further, a document reading device or scanner may be included in the apparatus in order to implement a digital copier or a facsimile apparatus. The illustrative embodiment is applicable even to an analog copier.

A paper P is fed from a paper feed device 13 to a nip between the drum 1 and an image transfer device 2 via a registration roller 14. The image transfer device 2 transfers the toner image from the drum 1 to the paper P. The paper with the toner image is conveyed to a fixing unit, not shown, by a transfer belt 2*a*. After the toner image has been fixed on the paper P by the fixing unit, the paper P is driven out of the apparatus to, e.g., a tray by an outlet roller (not shown).

While the toner deposited on the drum 1 is electrostatically transferred to the paper P, about 10% of the toner is left on the drum 1 after image transfer. A drum cleaning unit 3 has a cleaning blade 3*a* and a brush roller 3*b* for scraping off the toner left on the drum 1 after the image transfer. The toner collected by the cleaning unit 3 is dropped via an outlet 3*c* due to its own weight. Then, the toner is conveyed to a powder screw pump or air stream conveying means 4 by a toner guide 15 as collected or recycled toner T.

A belt cleaning unit 30 includes a cleaning blade 30*a* and removes the toner left on the transfer belt 2*a* of the image transfer device 2 contacting the drum 1 with the cleaning blade 30*a*. The toner collected by the belt cleaning unit 30 drops via an outlet 30*b* due to its own weight and is also delivered to the screw pump 4 by the toner guide 15 as collected toner.

The screw pump 4 delivers a mixture of the collected toner and air fed under pressure from the air pump or air feeding means 5 to a toner inlet 12*b* formed in the hopper 12*a* of the developing unit 12 via a mixture delivery path 6. The mixture delivery path 6 is implemented by an elastic tubing or a hard piping.

The length of the elastic tubing or hard piping constituting the mixture delivery path 6 depends on the size of the image forming apparatus. In the illustrative embodiment, the collected toner to be discarded is discharged toward the rear of the apparatus, as seen in the direction perpendicular to the sheet surface of FIG. 21, while the toner inlet 12*b* of the toner hopper 12 is positioned at the front of the same. Therefore, the tubing or the piping having an inside diameter of 4 mm to 6 mm is laid from the rear to the front, as seen in the above direction, taking account of easy manipulation.

In this embodiment, the mixture delivery path 6 is assumed to extend from one level or height to another level or height (inclined upward or vertical). A branch path 7 extends downward from the bottom of the upwardly extending portion of the path 6 where the toner is most likely to stay. The path 6 is communicated by the branch path 7 to the inlet 8*a* of a receptacle 8. Cohered toner, paper dust and other relatively coarse impurities contained in the air-toner mixture are collected in the receptacle 8. When a lid or cap 8*b* provided on the bottom of the receptacle 8 is removed, the receptacle 8 can be evacuated. Usually, the lid 8*b* is fitted on the receptacle 8 in order to prevent the air-toner mixture from leaking to the outside of the receptacle 8.

In the above configuration, so long as the air-toner mixture flows at a rate lower than a preselected rate, the cohered toner, paper dust and other coarse impurities which are heavier than the normal toner cannot rise up an upwardly inclined path 6A included in the path 6. As a result, such impurities are caused to drop in a direction B and collected in the receptacle 8. Therefore, only the normal toner having the expected small diameter is transferred to the developing unit 12, noticeably reducing defective images. This was confirmed by a series of experiments.

The air pump 5 feeds compressed air at a rate of 0.5 to 1.5 litters per minute; higher flow rates would cause the coarse impurities to return to the developing device 12 and render images defective.

In the illustrative embodiment, the coarse impurities collected in the receptacle 8 are discharged by opening the lid 8*b*, as needed. Alternatively, the coarse impurities may be transferred from the receptacle 8 to a greater bottle and then discarded.

The inclined path 6A terminates at the intermediate portion of a vertical pipe 6B (branch portion 70). The part of the vertical pipe 6B below the branch portion 70 is communicated to another receptacle 80 at its bottom. The receptacle 80, like the receptacle 8, has a connecting portion 80*a* and an openable lid 80*b*.

The branch portion 70 is positioned at the lower bent portion 6*a* of the mixture delivery path 6. Therefore, when both the screw pump 4 and air pump 5 are turned off, the collected toner remaining in the path 6 in the form of a powder cloud tends to drop into and stay at the bent portion 6*a*. The illustrative embodiment obviates troubles ascribable to such toner because the vertical pipe 6B extends further downward to the receptacle 80 and allows the toner to be collected in the receptacle 80.

The lid or cap 80*b* is usually closed in order to prevent the air-toner mixture from leaking to the outside of the receptacle 80. The air-toner mixture can therefore be smoothly conveyed without any toner staying at the bent portion 6*a* of the mixture delivery path 6; otherwise, the toner would flow reversely into the screw pump 4 and fly about to contaminate the inside of the apparatus while lowering image quality. The toner collected in the receptacle 80 may be discarded periodically or may be automatically removed by a device not shown.

Figure 22:
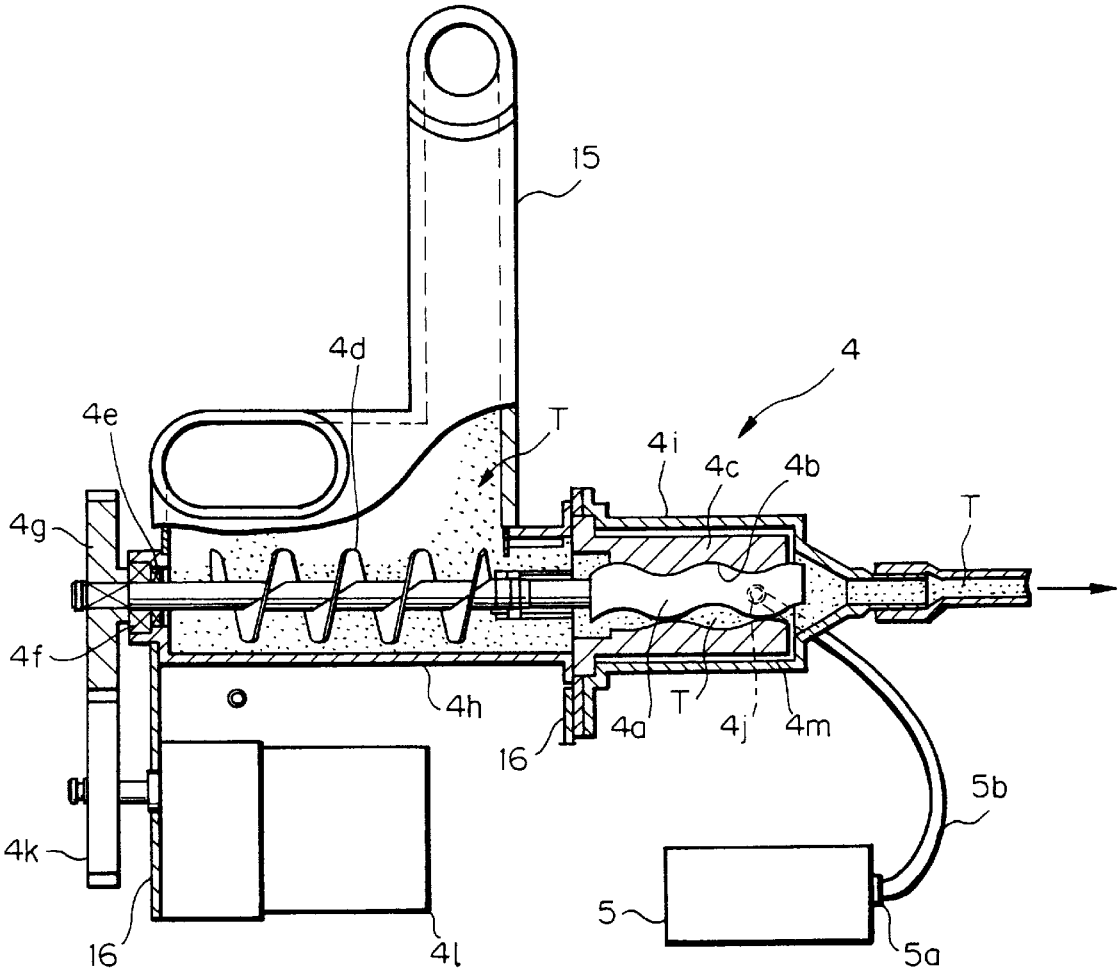
FIG. 22 shows a screw pump included in the third embodiment.

FIG. 22 shows a specific configuration of the air stream conveying means. As shown, the air stream conveying means is implemented as a powder screw pump or Mono pump including a rotor 4*a* and a stator 4*c* formed of rubber or similar elastic material and surrounding and contacting the rotor 4*a*. A passage 4*b* is formed throughout the stator 4*c*. The pump is mounted on a support member 16. The rotor 4*a* is engaged with one end of a screw 4*d* for horizontal conveyance. The other end of the screw 4*d* is engaged with a driven gear 4*g*, sealed by a seal member 4*e*, and rotatably supported by a bearing 4*f*. A hopper 4*h* accommodating the screw 4*d* is engaged with a toner guide member 17.

A gap 4*m* of about 1 mm is formed between the outer periphery of the stator 4*c* and the inner periphery of a holder 4*i*. An air inlet 4*j* is formed in the holder 4*i* in order to send air under pressure into the passage 4*b*. The air inlet 4*j* is communicated to the passage 4*b* and communicated to the delivery port 5*a* of the air pump 5 by the tubing 5*b*. Compressed air is delivered from the air pump 5 at a rate of 0.5 to 1.0 litter per minute. The rotation of a motor 41 mounted on the support member 16 is transferred to the screw 4*d* via the driven gear 4*j* and driven gear 4*g*.

Figure 23:
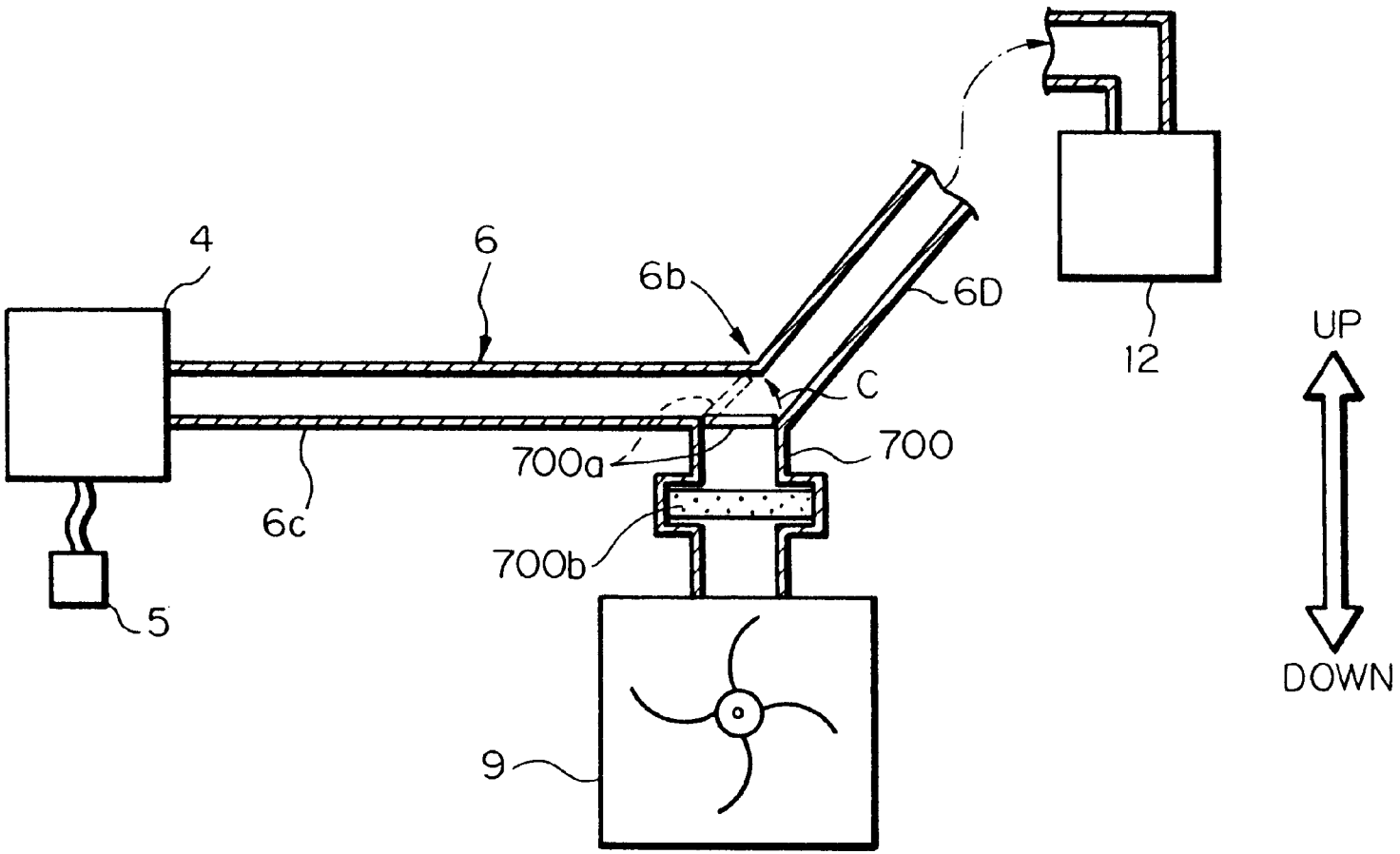
FIG. 23 shows an alternative configuration of a branch path also included in the third embodiment.

FIG. 23 shows a modification of the above embodiment. As shown, the mixture delivery path 6 includes a path 6C extending horizontally from the screw pump or air stream conveying means 4, and a path 6D extending from the end of the path 6C obliquely upward. A branch path 700 having an inside diameter of 4 to 6 mm extends downward from a bent portion 6*b* where the two paths 6C and 6D join each other. The branch path 700 is communicated to another air pump or air introducing means 9 via a valve 700*a* mounted on the end of the path 600 and a filter 700*b* positioned at the intermediate portion of the path 700 for obstructing the collected toner. The air pump 9 feeds compressed air to the bent portion 6*b* at a rate of 1.0 to 2.5 liters per minute, preventing the toner from staying at the bent portion 6*b*. The valve 700*a* is usually closed to prevent the air-toner mixture from entering the branch path 700.

Specifically, when the screw pump 4 and air pump 5 are turned off over a long period of time, the collected toner remaining in the mixture delivery path 6 in the form of a powder cloud drops into and stays at the bent portion 6*b*. However, after the screw pump 4 and and air pump 5 have been again turned on, the other air pump 9 is turned on on the elapse of a preselected period of time, e.g., before the image forming line starts operating for temperature elevation due to the OFF state of a fixing unit not shown. At the same time, the valve 700*a* is opened in a direction C. As a result, air under pressure is fed from the air pump 9 to the bent portion 6*b* in order to loosen the toner staying there. Consequently, the toner again turns out a toner cloud together with the compressed air and is smoothly conveyed toward the developing unit 12. Thereafter, the air pump 9 is turned off, and the screw pump 4 and air pump 5 are turned on in order to deliver the air-toner mixture to the developing unit 12; otherwise, the toner would flow reversely into the screw pump 4 and fly about to contaminate the inside of the apparatus while lowering image quality.

Assume that the screw pump 4 and air pump 5 are turned off over a long period of time with the fixing unit, not shown, remaining in its ON state. Then, the valve 700*a* and air pump 9 are operated first in order to loosen the toner staying at the bent portion 6*b* and cause it to form a powder cloud. Subsequently, the screw pump 4 and air pump 5 are again turned on in order to deliver the air-toner mixture to the developing unit 12.

As stated above, the illustrative embodiment achieves various unprecedented advantages, as enumerated below.

(1) Cohered toner, paper dust and other coarse impurities and toner tending to stay in the mixture delivery path are discharged via the branch path. Therefore, high quality images are achievable with a miniature image forming apparatus at low cost. Further, such impurities are prevented from flying about in the apparatus and can be collected and then discarded.

(2) The toner is prevented from staying at the bent portion included in the mixture delivery path. The air-toner mixture is prevented from entering the branch path or the air introducing means.

(3) Even after the delivery of the air-toner mixture in the mixture delivery path has been interrupted over a long period of time, the toner staying at the bent portion of the path is surely dissipated. That is, although the above toner is apt to solidify, even such toner can be loosened and effectively recycled.

Various modifications will become possible for those skilled in the art after receiving the teachings of the present disclosure without departing from the scope thereof.

What is claimed is:

1. An image forming apparatus capable of conveying toner collected by cleaning means to a preselected position, comprising:

toner conveying means comprising air stream conveying means, wherein said air streaming means comprises a screw pump, and air feeding means for conveying the toner to the preselected position in a form of an air-toner mixture; and a hopper portion positioned upstream of said toner conveying means in an intended direction of toner conveyance for causing the toner to accumulate in said hopper portion by dropping into the hopper portion by its own weight;

toner sensing means positioned in said hopper portion;

said toner conveying means being operated in response to an output of said toner sensing means showing that the toner has reached the preselected amount, wherein said toner conveying means is caused to operate for a preselected period of time and then stop operating, and wherein on the elapse of the preselected period of time since a start of operation said toner conveying means stops an operation of said screw pump and then stops an operation of said air feeding means.

2. An apparatus as claimed in claim 1, further comprising control means for determining, based on the output of said toner sensing means appearing after a stop of the operation of said toner conveying means, whether or not conveyance of the toner is defective.

3. An apparatus as claimed in claim 2, wherein said control means includes alarming means for producing an alarm when the conveyance of the toner is defective.

4. An image forming apparatus capable of conveying toner collected by cleaning means to a preselected position, comprising:

toner conveying means comprising air stream conveying means and air feeding means for conveying the toner to the preselected position in a form of an air-toner mixture; and a hopper portion positioned upstream of said toner conveying means in an intended direction of toner conveyance for causing the toner to accumulate in said hopper portion by dropping into the hopper portion by its own weight;

said toner conveying means being operated when the toner accumulating in said hopper portion reaches a preselected amount, wherein on the elapse of a preselected period of time since a start of operation said toner conveying means stops an operation of said air stream conveying means and then stops an operation of said air feeding means.

5. An image forming apparatus capable of conveying toner collected by cleaning means to a preselected position, comprising:

toner conveying means comprising air stream conveying means, wherein said air stream conveying means comprises a screw pump, and air feeding means for conveying the toner to the preselected position in a form of an air-toner mixture; and a hopper portion positioned upstream of said toner conveying means in an intended direction of toner conveyance for causing the toner to accumulate in said hopper portion by dropping into the hopper portion by its own weight;

wherein when a number of recording media to which images have been transferred reaches a preselected number, said toner conveying means is caused to operate, regarding that the toner accumulating in said hopper portion has reached the preselected amount, wherein said toner conveying means is caused to operate for a preselected period of time and then stop operating, and wherein on the elapse of the preselected period of time since a start of operation said toner conveying means stops an operation of said screw pump and then stops an operation of said air feeding means.

6. An image forming apparatus capable of conveying toner collected by cleaning means to a preselected position, comprising:

toner conveying means comprising air stream conveying means and air feeding means for conveying the toner to the preselected position in a form of an air-toner mixture; and a hopper portion positioned upstream of said toner conveying means in an intended direction of toner conveyance for causing the toner to accumulate in said hopper portion by dropping into the hopper portion by its own weight;

said toner conveying means being operated when the toner accumulating in said hopper portion is regarded as having reached a preselected amount, wherein on the elapse of a preselected period of time since a start of operation said toner conveying means stops an operation of said air stream conveying means and then stops an operation of said air feeding means.

7. An image forming apparatus including a toner recycling mechanism for collecting toner left on an image carrier after image transfer during an electrophotographic process by dropping into the hopper portion by its own weight, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount, wherein said air stream conveying means comprises a hollow cylindrical holder, a female screw type stator affixed within said holder, and a male screw type rotor rotatably received in said stator.

8. An apparatus as claimed in claim 7, wherein said sensing means comprises a sensor adjoining said image transferring means or a recording medium outlet roller for determining a number of recording media to which images have been transferred.

9. An apparatus as claimed in claim 8, wherein said control means causes said air stream conveying means to start conveying the toner in response to an output of said sensing means, continuously convey the said toner for a preselected period of time, and then stop conveying the toner.

10. An apparatus as claimed in claim 9, wherein said controller causes said air feeding means to start operating before causing said air stream conveying means to start operating, and then stop operating after a stop of operation of said air stream conveying means.

11. An apparatus as claimed in claim 10, wherein said control means causes said toner conveying means to start operating at a timing adjustable in accordance with a size of the recording medium.

12. An apparatus as claimed in claim 11, wherein when the size of the recording medium is smaller than a reference size, said air stream conveying means is driven at a same period as when said size is coincident with said reference size.

13. An apparatus as claimed in claim 12, wherein when the size of the recording medium is greater than the reference size, said air stream conveying means is driven at a shorter period than when said size is coincident with said reference size.

14. An apparatus as claimed in claim 13, wherein when the size of the recording medium is greater than the reference size, said air stream conveying means is driven at a period one-half shorter than when said size is coincident with said reference size.

15. An apparatus as claimed in claim 14, wherein when a jam sensor senses a jam, said control means causes said air stream conveying means to start conveying the toner or adjusts the timing for starting a toner conveying operation.

16. An image forming apparatus including a toner recycling mechanism for collecting toner left on an image carrier after image transfer during an electrophotographic process by dropping into the hopper portion by its own weight, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount, wherein said controller causes said air feeding means to start operating before causing said air stream conveying means to start operating, and then stop operating after a stop of operation of said air stream conveying means.

17. An image forming apparatus including a toner recycling mechanism for collecting toner left on an image carrier after image transfer during an electrophotographic process by dropping into the hopper portion by its own weight, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount, wherein said control means causes said toner conveying means to start operating at a timing adjustable in accordance with a size of the recording medium.

18. An image forming apparatus including a toner recycling mechanism for collecting toner left on an image carrier after image transfer during an electrophotographic process by dropping into the hopper portion by its own weight, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount, wherein when the size of the recording medium is smaller than a reference size, said air stream conveying means is driven at a same period as when said size is coincident with said reference size.

19. An image forming apparatus including a toner recycling mechanism for collecting toner left on an image carrier after image transfer during an electrophotographic process by dropping into the hopper portion by its own weight, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount, wherein when the size of the recording medium is greater than the reference size, said air stream conveying means is driven at a shorter period than when said size is coincident with said reference size.

20. An image forming apparatus including a toner recycling mechanism for collecting toner left on an image carrier after image transfer during an electrophotographic process by dropping into the hopper portion by its own weight, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount, wherein when the size of the recording medium is greater than the reference size, said air stream conveying means is driven at a period one-half shorter than when said size is coincident with said reference size.

21. An image forming apparatus including a toner recycling mechanism for collecting toner left on an image carrier after image transfer during an electrophotographic process by dropping into the hopper portion by its own weight, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount, wherein when a jam sensor senses a jam, said control means causes said air stream conveying means to start conveying the toner or adjusts the timing for starting a toner carrying operation.

22. An image forming apparatus capable of collecting toner left on an image carrier after image transfer during an electrophotographic process, and returning said toner to developing means for reuse in a form of an air-toner mixture, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means; and a first branch path branching off a part of said mixture delivery path having an upwardly extending portion extending from a lower position to an upper position; and a second branch path extending downward from a bottom of said upwardly extending portion of said first branch path to collect impurities from the air-toner mixture.

23. An apparatus as claimed in claim 22, wherein said first branch path is communicated to a first storing means and said second branch path is communicated to a second storing means.

24. An apparatus as claimed in claim 23, wherein said storing means is hermetically sealed.

25. An apparatus as claimed in claim 24, wherein said storing means comprises an opening for discharging impurities collected in said storing means, and a lid for openably closing said opening.

26. An apparatus as claimed in claim 22, wherein said first branch path extends from a bent portion of said mixture delivery path located at said lower position.

27. An apparatus as claimed in claim 26, wherein said first branch path is communicated to air introducing means.

28. An apparatus as claimed in claim 27, wherein said first branch path is communicated to said air introducing means via a valve.

29. An apparatus as claimed in claim 28, wherein said first branch path is communicated to said air introducing means via a filter.

30. An apparatus as claimed in claim 29, wherein said air introducing means is caused to start introducing air prior to an air-toner mixture conveying operation to occur in said mixture delivery path.

31. An apparatus as claimed in claim 22, wherein said first branch path is communicated to said air introducing means via a filter.

32. An image forming apparatus capable of collecting toner left on an image carrier after image transfer during an electrophotographic process, and returning said toner to developing means for reuse in a form of an air-toner mixture, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means; and a branch path branching off a part of said mixture delivery path extending from a lower position to an upper position;

wherein said air introducing means is caused to start introducing air prior to an air-toner mixture conveying operation to occur in said mixture delivery path.

33. An image forming apparatus capable of conveying toner collected by cleaning means to a preselected position, comprising:

toner conveying means comprising air stream conveying means and air feeding means for conveying the toner to the preselected position in a form of an air-toner mixture; and a hopper portion positioned upstream of said toner conveying means in an intended direction of toner conveyance for causing the toner to accumulate in said hopper portion, said toner conveying means being operated when the toner accumulating in said hopper portion reaches a preselected amount, and wherein on the elapse of a preselected period of time since a start of operation said toner conveying means stops an operation of said air stream conveying means and then stops an operation of said air feeding means.

34. An apparatus as claimed in claim 33, wherein said air stream conveying means comprises a screw pump.

35. An apparatus as claimed in claim 34, further comprising toner sensing means positioned in said hopper portion, said toner conveying means being operated in response to an output of said toner sensing means showing that the toner has reached the preselected amount.

36. An apparatus as claimed in claim 35, wherein said toner conveying means is caused to operate for a preselected period of time and then stop operating.

37. An apparatus as claimed in claim 36, further comprising control means for determining, based on the output of said toner sensing means appearing after a stop of the operation of said toner conveying means, whether or not conveyance of the toner is defective.

38. An apparatus as claimed in claim 37, wherein said control means includes alarming means for producing an alarm when the conveyance of the toner is defective.

39. An apparatus as claimed in claim 35, wherein said toner sensing means is located in the vicinity of a toner inlet of said screw pump and senses, as the preselected amount, an amount only great enough to substantially bury said toner inlet therein.

40. An apparatus as claimed in claim 33, wherein said toner conveying means is caused to operate for a preselected period of time and then stop operating.

41. An apparatus as claimed in claim 33, wherein the preselected position to which the toner is conveyed by said toner conveying means is developing means.

42. An apparatus as claimed in claim 33, wherein the preselected position to which the toner is conveyed by said toner conveying means is a portion storing toner or a developer to be replenished into developing means.

43. An image forming apparatus capable of conveying toner collected by cleaning means to a preselected position, comprising:

toner conveying means comprising air stream conveying means and air feeding means for conveying the toner to the preselected position in a form of an air-toner mixture; and a hopper portion positioned upstream of said toner conveying means in an intended direction of toner conveyance for causing the toner to accumulate in said hopper portion;

said toner conveying means being operated when the toner accumulating in said hopper portion is regarded as having reached a preselected amount, and wherein on the elapse of a preselected period of time since a start of operation said toner conveying means stops an operation of said screw pump and then stops an operation of said air feeding means.

44. An apparatus as claimed in claim 43, wherein said air stream conveying means comprises a screw pump.

45. An apparatus as claimed in claim 44, wherein when a number of recording media to which images have been transferred reaches a preselected number, said toner conveying means is caused to operate, regarding that the toner accumulating in said hopper portion has reached the preselected amount.

46. An apparatus claimed in claim 45, wherein said toner conveying means is caused to operate for a preselected period of time and then stop operating.

47. An apparatus as claimed in claim 43, further comprising pixel detecting means for determining a number of pixels during image formation, said toner conveying means being caused to operate when the number of pixels counted by said pixel detecting means reaches a preselected number, regarding that the toner accumulating in said hopper portion has reached the preselected amount.

48. An apparatus as claimed in claim 43, wherein said toner conveying means is caused to operate for a preselected period of time and then stop operating.

49. An apparatus as claimed in claim 43, wherein the preselected position to which the toner is conveyed by said toner conveying means is developing means.

50. An apparatus as claimed in claim 43, wherein the preselected position to which the toner is conveyed by said toner conveying means is a portion storing toner or a developer to be replenished into developing means.

51. An image forming apparatus including a toner recycling mechanism for collecting toner left on an image carrier after image transfer during an electrophotographic process, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed;

control means for causing said air stream conveying means to start conveying the toner when said sensing means determines that the amount of toner images has reached a preselected amount; and wherein said air stream conveying means comprises a hollow cylindrical holder, a female screw type stator affixed within said holder, and a male screw type rotor rotatably received in said stator.

52. An apparatus as claimed in claim 51, wherein said sensing means comprises a sensor adjoining said image transferring means or a recording medium outlet roller for determining a number of recording media to which images have been transferred.

53. An apparatus as claimed in claim 52, wherein said control means causes said air stream conveying means to start conveying the toner in response to an output of said sensing means, continuously convey the said toner for a preselected period of time, and then stop conveying the toner.

54. An apparatus as claimed in claim 53, wherein said controller causes said air feeding means to start operating before causing said air stream conveying means to start operating, and then stop operating after a stop of operation of said air stream conveying means.

55. An apparatus as claimed in claim 54, wherein said control means causes said toner conveying means to start operating at a timing adjustable in accordance with a size of the recording medium.

56. An apparatus as claimed in claim 55, wherein when the size of the recording medium is smaller than a reference size, said air stream conveying means is driven at a same period as when said size is coincident with said reference size.

57. An apparatus as claimed in claim 56, wherein when the size of the recording medium is greater than the reference size, said air stream conveying means is driven at a shorter period than when said size is coincident with said reference size.

58. An apparatus as claimed in claim 57, wherein when the size of the recording medium is greater than the reference size, said air stream conveying means is driven at a period one-half shorter than when said size is coincident with said reference size.

59. An apparatus as claimed in claim 58, wherein when a jam sensor senses a jam, said control means causes said air stream conveying means to start conveying the toner or adjusts the timing for starting a toner conveying operation.

60. An apparatus as claimed in claim 51, wherein said sensing means comprises a sensor adjoining said image transferring means or a recording medium outlet roller for determining a number of recording media to which images have been transferred.

61. An apparatus as claimed in claim 51, wherein said control means causes said air stream conveying means to start conveying the toner in response to an output of said sensing means, continuously convey the toner for a preselected period of time, and then stop conveying the toner, wherein said controller causes said air feeding means to start operating before causing said air stream conveying means to start operating, and then stop operating after a stop of operation of said air stream conveying means.

62. An image forming apparatus including a toner recycling mechanism for collecting toner left on an image carrier after image transfer during an electrophotographic process, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount;

wherein said controller causes said air feeding means to start operating before causing said air stream conveying means to start operating, and then stop operating after a stop of operation of said air stream conveying means.

63. An image forming apparatus including a toner recycling mechanism for collecting toner left on an image carrier after image transfer during an electrophotographic process, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount;

wherein said control means causes said toner conveying means to start operating at a timing adjustable in accordance with a size of the recording medium.

64. An image forming apparatus including a toner recycling mechanism for collecting toner left on an image carrier after image transfer during an electrophotographic process, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount;

wherein when the size of the recording medium is smaller than a reference size, said air stream conveying means is driven at a same period as when said size is coincident with said reference size.

65. An image forming apparatus including a toner recycling mechanism for collecting toner left on an image carrier after image transfer during an electrophotographic process, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount;

wherein when the size of the recording medium is greater than the reference size, said air stream conveying means is driven at a shorter period than when said size is coincident with said reference size.

66. An image forming apparatus including a toner recycling mechanism for collecting toner left on an image carrier after image transfer during an electrophotographic process, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount;

wherein when the size of the recording medium is greater than the reference size, said air stream conveying means is driven at a period one-half shorter than when said size is coincident with said reference size.

67. An image forming apparatus including a toner recycling mechanism for collecting toner left on an image carrier after image transfer during an electrophotographic process, and returning said toner to developing means for reuse in a form of an air-toner mixture or conveying said toner to a waste toner container, said image forming apparatus comprising:

image transferring means for transferring a toner image formed on the image carrier to a recording medium;

cleaning means for collecting the toner left on the image carrier;

air stream conveying means for mixing the toner with air and conveying said toner in the form of the air-toner mixture;

air feeding means for feeding air for fluidizing the toner to be conveyed by said air stream conveying means;

a mixture delivery path comprising an elastic tubing for delivering the air-toner mixture to the developing means or the waste toner container;

sensing means for determining an amount of toner images formed; and control means for causing said air stream conveying means to start conveying the toner when said sensing means determines that the amount of toner images has reached a preselected amount;

wherein when a jam sensor senses a jam, said control means causes said air stream conveying means to start conveying the toner or adjusts the timing for starting a toner conveying operation.

* * * * *